US007889168B2

(12) United States Patent
Yamazaki et al.

(10) Patent No.: US 7,889,168 B2
(45) Date of Patent: Feb. 15, 2011

(54) IMAGE DISPLAY APPARATUS

(75) Inventors: Tatsuro Yamazaki, Tokyo (JP); Naoto Abe, Tokyo (JP); Eisaku Tatsumi, Kanagawa (JP); Makiko Mori, Kanagawa (JP); Muneki Ando, Kanagawa (JP); Takeshi Ikeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1031 days.

(21) Appl. No.: 11/676,620

(22) Filed: Feb. 20, 2007

(65) Prior Publication Data

US 2007/0139302 A1 Jun. 21, 2007

Related U.S. Application Data

(63) Continuation of application No. 10/680,221, filed on Oct. 8, 2003, now Pat. No. 7,227,521.

(30) Foreign Application Priority Data

Oct. 9, 2002 (JP) ..... 2002-296642

(51) Int. Cl.
*G09G 3/36* (2006.01)

(52) U.S. Cl. ..... 345/99; 345/208; 345/690

(58) Field of Classification Search ..... 345/3.1–3.3, 345/87–100, 213, 55, 74.1, 75.2, 76, 77, 345/84, 204, 208, 690
See application file for complete search history.

(56) References Cited

U.S. PATENT DOCUMENTS 5,032,832 A 7/1991 Clerc et al. ..... 340/805

(Continued)

FOREIGN PATENT DOCUMENTS

EP 0 272 079 6/1988

(Continued)

OTHER PUBLICATIONS

European Office Action dated Jul. 20, 2009, in related corresponding European Patent Appln. No. 03022492.7.

*Primary Examiner*—Regina Liang
(74) *Attorney, Agent, or Firm*—Fitzpatrick, Cella, Harper & Scinto

(57) ABSTRACT

An image display apparatus includes a plurality of display devices, a plurality of scan interconnections and a plurality of modulation interconnections, a scanning circuit for applying a scanning signal to the scan interconnections, and a modulation circuit for applying a modulation signal to the modulation interconnections. The scanning circuit applies the scanning signals to a group of scan interconnections selected from the plurality of scan interconnections in one select period, and applies the scanning signals, in a subsequent select period, to the plurality of scanning interconnections which were shifted with one scan interconnection portion from the group of scanning interconnections to which the scanning signals were applied in a previous select period. The scanning signals which have the same polarity to the modulation signal in successive two select periods are applied to the scanning interconnection to which the scanning signals should be applied repeatedly, and the output from the scanning circuit has a portion in which signal level is controlled to a non-selection electric potential level between the scanning signals which are applied repeatedly to the scanning interconnection. The scanning circuit is configured to apply scanning signals with different selection electric potentials to a plurality of scan interconnections which are selected in one select period.

8 Claims, 18 Drawing Sheets

U.S. PATENT DOCUMENTS

| | | | | |
|---|---|---|---|---|
| 5,455,597 | A | 10/1995 | Nakamura et al. | 345/75 |
| 5,659,329 | A | 8/1997 | Yamanobe et al. | 345/74 |
| 5,742,270 | A | 4/1998 | Kuo | 345/100 |
| 5,818,403 | A | 10/1998 | Nakamura et al. | 345/74 |
| 5,844,536 | A | 12/1998 | Okada et al. | 345/94 |
| 5,854,859 | A | 12/1998 | Sobol | 382/261 |
| 6,097,440 | A | 8/2000 | Omori et al. | 348/542 |
| 6,100,872 | A | 8/2000 | Aratani et al. | 345/147 |
| 6,222,517 | B1 * | 4/2001 | Iba et al. | 345/94 |
| 6,310,662 | B1 | 10/2001 | Sunakawa et al. | 348/747 |
| 6,366,026 | B1 | 4/2002 | Saito et al. | 315/169.3 |
| 6,476,801 | B2 * | 11/2002 | Nagai | 345/213 |
| 6,515,641 | B1 | 2/2003 | Sagano et al. | 345/76 |
| 6,552,702 | B1 | 4/2003 | Abe et al. | 345/75.2 |
| 6,603,450 | B1 | 8/2003 | Yamazaki et al. | 345/75.2 |
| 6,831,633 | B1 | 12/2004 | Murade | 345/204 |
| 6,876,476 | B1 | 4/2005 | Miura et al. | 359/252 |
| 6,919,003 | B2 | 7/2005 | Ikeda et al. | 204/490 |
| 6,924,796 | B1 | 8/2005 | Someya et al. | 345/98 |
| 7,030,851 | B2 | 4/2006 | Yamazaki | 345/100 |
| 7,227,521 | B2 * | 6/2007 | Yamazaki et al. | 345/84 |
| 2002/0154101 | A1 | 10/2002 | Abe et al. | 345/204 |
| 2003/0011545 | A1 | 1/2003 | Sagano et al. | 345/76 |
| 2003/0016429 | A1 | 1/2003 | Ikeda et al. | 359/238 |
| 2003/0020698 | A1 | 1/2003 | Ando | 345/204 |
| 2003/0048521 | A1 | 3/2003 | Ikeda et al. | 359/296 |

FOREIGN PATENT DOCUMENTS

| | | |
|---|---|---|
| JP | 2-5088 | 1/1990 |
| JP | 5-216433 | 8/1993 |
| JP | 6-342636 | 12/1994 |
| JP | 8-50462 | 2/1996 |
| JP | 8-212944 | 8/1996 |
| JP | 8-331490 | 12/1996 |
| JP | 10-233981 | 9/1998 |
| JP | 2000-267624 | 9/2000 |
| JP | 2001-100710 | 4/2001 |
| JP | 3-262175 | 12/2001 |
| JP | 3262175 | 12/2001 |
| JP | 3262715 | 12/2001 |

* cited by examiner

ORIGINAL IMAGE

| | | | | | | | | |
|---|---|---|---|---|---|---|---|---|
| | 60 | 78 | 50 | 100 | 55 | 55 | 55 | 55 |
| | 80 | 80 | 57 | 90 | 60 | 60 | 40 | 35 |
| A | 100 | 107 | 140 | 130 | 102 | 60 | 55 | 30 |
| B | 120 | 140 | 155 | 180 | 100 | 45 | 58 | 20 |
| C | 140 | 150 | 170 | 200 | 180 | 100 | 80 | 50 |
| D | 160 | 120 | 70 | 100 | 40 | 100 | 56 | 30 |
| E | 150 | 140 | 90 | 150 | 50 | 110 | 60 | 20 |
| F | 140 | 100 | 90 | 130 | 90 | 180 | 130 | 100 |
| G | 130 | 90 | 80 | 100 | 70 | 205 | 170 | 150 |
| H | 120 | 70 | 77 | 89 | 178 | 220 | 190 | 180 |

*Fig. 10A*

EDGE EMPHASIS TO ORIGINAL IMAGE (2B-A/2-C/2)

| | | | | | | | |
|---|---|---|---|---|---|---|---|
| | | | | | | | |
| 80 | 67.5 | 19 | 65 | 41.5 | 62.5 | 25 | 27.5 |
| 100 | 104 | 174 | 125 | 124 | 67.5 | 61 | 32.5 |
| 120 | 152 | 155 | 195 | 59 | 10 | 48.5 | 0 |
| 140 | 170 | 228 | 260 | 290 | 128 | 103 | 75 |
| 175 | 95 | 10 | 25 | -35 | 95 | 42 | 25 |
| 150 | 170 | 100 | 185 | 35 | 80 | 27 | -25 |
| 140 | 85 | 95 | 135 | 120 | 203 | 145 | 115 |
| 130 | 95 | 76.5 | 90.5 | 6 | 210 | 180 | 160 |
| | | | | | | | |

*Fig. 10B*

MIDSTREAM OF NORMALIZATION (HALF TRANSITION)

| | | | | | | | |
|---|---|---|---|---|---|---|---|
| | | | | | | | |
| 80 | 67.5 | 19 | 65 | 41.5 | 62.5 | 25 | 27.5 |
| 100 | 104 | 174 | 125 | 124 | 67.5 | 61 | 32.5 |
| 120 | 152 | 155 | 196 | 67.8 | 10 | 48.5 | 0 |
| 140 | 170 | 228 | 260 | 281 | 128 | 103 | 75 |
| 175 | 95 | 10 | 26.3 | -26 | 95 | 42 | 18.8 |
| 150 | 170 | 100 | 185 | 26.3 | 80 | 27 | -25 |
| 140 | 85 | 95 | 135 | 120 | 203 | 145 | 109 |
| 130 | 95 | 76.5 | 90.5 | 6 | 210 | 180 | 160 |
| | | | | | | | |

*Fig. 10C*

NORMALIZE RESULT OF EDGE EMPHASIS TO 0 TO 255

| | | | | | | | |
|---|---|---|---|---|---|---|---|
| | | | | | | | |
| 80 | 67.5 | 19 | 65 | 41.5 | 62.5 | 25 | 27.5 |
| 100 | 104 | 174 | 125 | 124 | 67.5 | 61 | 32.5 |
| 120 | 152 | 155 | 196 | 67.8 | 10 | 48.5 | 0 |
| 140 | 170 | 228 | 255 | 255 | 128 | 103 | 75 |
| 175 | 95 | 10 | 26.3 | 0 | 95 | 42 | 18.8 |
| 150 | 170 | 100 | 185 | 26.3 | 80 | 27 | 0 |
| 140 | 85 | 95 | 135 | 120 | 203 | 145 | 109 |
| 130 | 95 | 76.5 | 90.5 | 6 | 210 | 180 | 160 |
| | | | | | | | |

*Fig. 10D*

TREBLE VALUE OF ORIGINAL IMAGE

| | | | | | | | |
|---|---|---|---|---|---|---|---|
| 180 | 234 | 150 | 300 | 165 | 165 | 165 | 165 |
| 240 | 240 | 171 | 270 | 180 | 180 | 120 | 105 |
| 300 | 321 | 420 | 390 | 306 | 180 | 165 | 90 |
| 360 | 420 | 465 | 540 | 300 | 135 | 174 | 60 |
| 420 | 450 | 510 | 600 | 540 | 300 | 240 | 150 |
| 480 | 360 | 210 | 300 | 120 | 300 | 168 | 90 |
| 450 | 420 | 270 | 450 | 150 | 330 | 180 | 60 |
| 420 | 300 | 270 | 390 | 270 | 540 | 390 | 300 |
| 390 | 270 | 240 | 300 | 210 | 615 | 510 | 450 |
| 360 | 210 | 231 | 267 | 534 | 660 | 570 | 540 |

*Fig. 10E*

ONLY THREE LINE SIMULTANEOUS DRIVE

| | | | | | | | |
|---|---|---|---|---|---|---|---|
| | | | | | | | |
| 240 | 265 | 247 | 320 | 217 | 175 | 150 | 120 |
| 300 | 327 | 352 | 400 | 262 | 165 | 153 | 85 |
| 360 | 397 | 465 | 510 | 382 | 205 | 193 | 100 |
| 420 | 410 | 395 | 480 | 320 | 245 | 194 | 100 |
| 450 | 410 | 330 | 450 | 270 | 310 | 196 | 100 |
| 450 | 360 | 250 | 380 | 180 | 390 | 246 | 150 |
| 420 | 330 | 260 | 380 | 210 | 495 | 360 | 270 |
| 390 | 260 | 247 | 319 | 338 | 605 | 490 | 430 |
| | | | | | | | |

*Fig. 10F*

THREE LINE SIMULTANEOUS DRIVE BY VALUE AFTER EDGE EMPHASIS

| | | | | | | | |
|---|---|---|---|---|---|---|---|
| | | | | | | | |
| | | | | | | | |
| 300 | 323 | 348 | 385 | 225 | 140 | 135 | 60 |
| 360 | 426 | 557 | 580 | 473 | 205 | 213 | 108 |
| 435 | 417 | 393 | 480 | 314 | 233 | 194 | 100 |
| 465 | 435 | 338 | 470 | 290 | 303 | 172 | 75 |
| 465 | 350 | 205 | 345 | 120 | 378 | 214 | 115 |
| 420 | 350 | 272 | 411 | 161 | 493 | 352 | 250 |
| | | | | | | | |
| | | | | | | | |

*Fig. 10G*

THREE LINE SIMULTANEOUS DRIVE BY VALUE AFTER NORMALIZATION

| | | | | | | | |
|---|---|---|---|---|---|---|---|
| | | | | | | | |
| | | | | | | | |
| 300 | 323 | 348 | 386 | 233 | 140 | 135 | 60 |
| 360 | 426 | 557 | 576 | 447 | 205 | 213 | 108 |
| 435 | 417 | 393 | 478 | 323 | 233 | 194 | 93.8 |
| 465 | 435 | 338 | 466 | 281 | 303 | 172 | 93.8 |
| 465 | 350 | 205 | 346 | 146 | 378 | 214 | 128 |
| 420 | 350 | 272 | 411 | 152 | 493 | 352 | 269 |
| | | | | | | | |
| | | | | | | | |

*Fig. 10H*

ORIGINAL IMAGE

| | | | | | | | | |
|---|---|---|---|---|---|---|---|---|
| | 60 | 78 | 50 | 100 | 55 | 55 | 55 | 55 |
| | 80 | 80 | 57 | 90 | 60 | 60 | 40 | 35 |
| A | 100 | 107 | 140 | 130 | 102 | 60 | 55 | 30 |
| B | 120 | 140 | 155 | 180 | 100 | 45 | 58 | 20 |
| C | 140 | 150 | 170 | 200 | 180 | 100 | 80 | 50 |
| D | 160 | 120 | 70 | 100 | 40 | 100 | 56 | 30 |
| E | 150 | 140 | 90 | 150 | 50 | 110 | 60 | 20 |
| F | 140 | 100 | 90 | 130 | 90 | 180 | 130 | 100 |
| G | 130 | 90 | 80 | 100 | 70 | 205 | 170 | 150 |
| H | 120 | 70 | 77 | 89 | 178 | 220 | 190 | 180 |

*Fig. 12A*

EDGE EMPHASIS TO ORIGINAL IMAGE (1.5B-A/2)

| | | | | | | | |
|---|---|---|---|---|---|---|---|
| | | | | | | | |
| 90 | 81 | 60.5 | 85 | 62.5 | 62.5 | 32.5 | 25 |
| 110 | 121 | 182 | 150 | 123 | 60 | 62.5 | 27.5 |
| 130 | 157 | 163 | 205 | 99 | 37.5 | 59.5 | 15 |
| 150 | 155 | 178 | 210 | 220 | 128 | 91 | 65 |
| 170 | 105 | 20 | 50 | -30 | 100 | 44 | 20 |
| 145 | 150 | 100 | 175 | 55 | 115 | 62 | 15 |
| 135 | 80 | 90 | 120 | 110 | 215 | 165 | 140 |
| 125 | 85 | 75 | 85 | 60 | 218 | 190 | 175 |
| 115 | 60 | 75.5 | 83.5 | 232 | 228 | 200 | 195 |

*Fig. 12B*

MIDSTREAM OF NORMALIZATION (ONLY HALF TRANSITION)

| | | | | | | | |
|---|---|---|---|---|---|---|---|
| | | | | | | | |
| 90 | 81 | 60.5 | 85 | 62.5 | 62.5 | 32.5 | 25 |
| 110 | 121 | 182 | 150 | 123 | 60 | 62.5 | 27.5 |
| 130 | 157 | 163 | 205 | 99 | 37.5 | 59.5 | 15 |
| 150 | 155 | 178 | 210 | 213 | 128 | 91 | 65 |
| 170 | 105 | 20 | 50 | -30 | 100 | 44 | 20 |
| 145 | 150 | 100 | 175 | 47.5 | 115 | 62 | 15 |
| 135 | 80 | 90 | 120 | 110 | 215 | 165 | 140 |
| 125 | 85 | 75 | 85 | 60 | 218 | 190 | 175 |
| 115 | 60 | 75.5 | 83.5 | 232 | 228 | 200 | 195 |

*Fig. 12C*

NORMALIZE RESULT OF EDGE EMPHASIS TO 0 TO 255

| | | | | | | | |
|---|---|---|---|---|---|---|---|
| | | | | | | | |
| 90 | 81 | 60.5 | 85 | 62.5 | 62.5 | 32.5 | 25 |
| 110 | 121 | 182 | 150 | 123 | 60 | 62.5 | 27.5 |
| 130 | 157 | 163 | 205 | 99 | 37.5 | 59.5 | 15 |
| 150 | 155 | 178 | 210 | 213 | 128 | 91 | 65 |
| 170 | 105 | 20 | 50 | 0 | 100 | 44 | 20 |
| 145 | 150 | 100 | 175 | 47.5 | 115 | 62 | 15 |
| 135 | 80 | 90 | 120 | 110 | 215 | 165 | 140 |
| 125 | 85 | 75 | 85 | 60 | 218 | 190 | 175 |
| 115 | 60 | 75.5 | 83.5 | 232 | 228 | 200 | 195 |

*Fig. 12D*

DOUBLE VALUE OF ORIGINAL IMAGE

| | | | | | | | |
|---|---|---|---|---|---|---|---|
| 120 | 156 | 100 | 200 | 110 | 110 | 110 | 110 |
| 160 | 160 | 114 | 180 | 120 | 120 | 80 | 70 |
| 200 | 214 | 280 | 260 | 204 | 120 | 110 | 60 |
| 240 | 280 | 310 | 360 | 200 | 90 | 116 | 40 |
| 280 | 300 | 340 | 400 | 360 | 200 | 160 | 100 |
| 320 | 240 | 140 | 200 | 80 | 200 | 112 | 60 |
| 300 | 280 | 180 | 300 | 100 | 220 | 120 | 40 |
| 280 | 200 | 180 | 260 | 180 | 360 | 260 | 200 |
| 260 | 180 | 160 | 200 | 140 | 410 | 340 | 300 |
| 240 | 140 | 154 | 178 | 356 | 440 | 380 | 360 |

*Fig. 12E*

ONLY TWO LINE SIMULTANEOUS DRIVE

| | | | | | | | |
|---|---|---|---|---|---|---|---|
| | | | | | | | |
| 140 | 158 | 107 | 190 | 115 | 115 | 95 | 90 |
| 180 | 187 | 197 | 220 | 162 | 120 | 95 | 65 |
| 220 | 247 | 295 | 310 | 202 | 105 | 113 | 50 |
| 260 | 290 | 325 | 380 | 280 | 145 | 138 | 70 |
| 300 | 270 | 240 | 300 | 220 | 200 | 136 | 80 |
| 310 | 260 | 160 | 250 | 90 | 210 | 116 | 50 |
| 290 | 240 | 180 | 280 | 140 | 290 | 190 | 120 |
| 270 | 190 | 170 | 230 | 160 | 385 | 300 | 250 |
| 250 | 160 | 157 | 189 | 248 | 425 | 360 | 330 |

*Fig. 12F*

TWO LINE SIMULTANEOUS DRIVE BY VALUE AFTER EDGE EMPHASIS

| | | | | | | | |
|---|---|---|---|---|---|---|---|
| | | | | | | | |
| | | | | | | | |
| 200 | 202 | 242 | 235 | 186 | 123 | 95 | 52.5 |
| 240 | 277 | 344 | 355 | 222 | 97.5 | 122 | 42.5 |
| 280 | 312 | 340 | 415 | 319 | 165 | 151 | 80 |
| 320 | 260 | 198 | 260 | 190 | 228 | 135 | 85 |
| 315 | 255 | 120 | 225 | 25 | 215 | 106 | 35 |
| 280 | 230 | 190 | 295 | 165 | 330 | 227 | 155 |
| 260 | 165 | 165 | 205 | 170 | 433 | 355 | 315 |
| | | | | | | | |

*Fig. 12G*

TWO LINE SIMULTANEOUS DRIVE BY VALUE AFTER NORMALIZATION

| | | | | | | | |
|---|---|---|---|---|---|---|---|
| | | | | | | | |
| | | | | | | | |
| 200 | 202 | 242 | 235 | 186 | 123 | 95 | 52.5 |
| 240 | 277 | 344 | 355 | 222 | 97.5 | 122 | 42.5 |
| 280 | 312 | 340 | 415 | 312 | 165 | 151 | 80 |
| 320 | 260 | 198 | 260 | 213 | 228 | 135 | 85 |
| 315 | 255 | 120 | 225 | 47.5 | 215 | 106 | 35 |
| 280 | 230 | 190 | 295 | 158 | 330 | 227 | 155 |
| 260 | 165 | 165 | 205 | 170 | 433 | 355 | 315 |
| | | | | | | | |

*Fig. 12H*

ORIGINAL IMAGE

| | | | | | | | | |
|---|---|---|---|---|---|---|---|---|
| | 60 | 78 | 50 | 100 | 55 | 55 | 55 | 55 |
| | 80 | 80 | 57 | 90 | 60 | 60 | 40 | 35 |
| A | 100 | 107 | 140 | 130 | 102 | 60 | 55 | 30 |
| B | 120 | 140 | 155 | 180 | 100 | 45 | 58 | 20 |
| C | 140 | 150 | 170 | 200 | 180 | 100 | 80 | 50 |
| D | 160 | 120 | 70 | 100 | 40 | 100 | 56 | 30 |
| E | 150 | 140 | 90 | 150 | 50 | 110 | 60 | 20 |
| F | 140 | 100 | 90 | 130 | 90 | 180 | 130 | 100 |
| G | 130 | 90 | 80 | 100 | 70 | 205 | 170 | 150 |
| H | 120 | 70 | 77 | 89 | 178 | 220 | 190 | 180 |

*Fig. 14A*

EDGE EMPHASIS TO ORIGINAL IMAGE (2B-A/2-C/2)

| | | | | | | | |
|---|---|---|---|---|---|---|---|
| | | | | | | | |
| 80 | 67.5 | 19 | 65 | 41.5 | 62.5 | 25 | 27.5 |
| 100 | 104 | 174 | 125 | 124 | 67.5 | 61 | 32.5 |
| 120 | 152 | 155 | 195 | 59 | 10 | 48.5 | 0 |
| 140 | 170 | 228 | 260 | 290 | 128 | 103 | 75 |
| 175 | 95 | 10 | 25 | -35 | 95 | 42 | 25 |
| 150 | 170 | 100 | 185 | 35 | 80 | 27 | -25 |
| 140 | 85 | 95 | 135 | 120 | 203 | 145 | 115 |
| 130 | 95 | 76.5 | 90.5 | 6 | 210 | 180 | 160 |
| | | | | | | | |

*Fig. 14B*

MIDSTREAM OF NORMALIZATION (HALF TRANSITION)

| | | | | | | | |
|---|---|---|---|---|---|---|---|
| | | | | | | | |
| 80 | 67.5 | 19 | 65 | 41.5 | 62.5 | 25 | 27.5 |
| 100 | 104 | 174 | 125 | 124 | 67.5 | 61 | 32.5 |
| 120 | 152 | 155 | 196 | 67.8 | 10 | 48.5 | 0 |
| 140 | 170 | 228 | 260 | 281 | 128 | 103 | 75 |
| 175 | 95 | 10 | 26.3 | -26 | 95 | 42 | 18.8 |
| 150 | 170 | 100 | 185 | 26.3 | 80 | 27 | -25 |
| 140 | 85 | 95 | 135 | 120 | 203 | 145 | 109 |
| 130 | 95 | 76.5 | 90.5 | 6 | 210 | 180 | 160 |
| | | | | | | | |

*Fig. 14C*

NORMALIZE RESULT OF EDGE EMPHASIS TO 0 TO 255

| | | | | | | | |
|---|---|---|---|---|---|---|---|
| | | | | | | | |
| 80 | 67.5 | 19 | 65 | 41.5 | 62.5 | 25 | 27.5 |
| 100 | 104 | 174 | 125 | 124 | 67.5 | 61 | 32.5 |
| 120 | 152 | 155 | 196 | 67.8 | 10 | 48.5 | 0 |
| 140 | 170 | 228 | 255 | 255 | 128 | 103 | 75 |
| 175 | 95 | 10 | 26.3 | 0 | 95 | 42 | 18.8 |
| 150 | 170 | 100 | 185 | 26.3 | 80 | 27 | 0 |
| 140 | 85 | 95 | 135 | 120 | 203 | 145 | 109 |
| 130 | 95 | 76.5 | 90.5 | 6 | 210 | 180 | 160 |
| | | | | | | | |

*Fig. 14D*

DOUBLE VALUE OF ORIGINAL IMAGE

| | | | | | | | |
|---|---|---|---|---|---|---|---|
| 120 | 156 | 100 | 200 | 110 | 110 | 110 | 110 |
| 160 | 160 | 114 | 180 | 120 | 120 | 80 | 70 |
| 200 | 214 | 280 | 260 | 204 | 120 | 110 | 60 |
| 240 | 280 | 310 | 360 | 200 | 90 | 116 | 40 |
| 280 | 300 | 340 | 400 | 360 | 200 | 160 | 100 |
| 320 | 240 | 140 | 200 | 80 | 200 | 112 | 60 |
| 300 | 280 | 180 | 300 | 100 | 220 | 120 | 40 |
| 280 | 200 | 180 | 260 | 180 | 360 | 260 | 200 |
| 260 | 180 | 160 | 200 | 140 | 410 | 340 | 300 |
| 240 | 140 | 154 | 178 | 356 | 440 | 380 | 360 |

*Fig. 14E*

ONLY THREE LINE AUXILIARY DRIVE

| | | | | | | | |
|---|---|---|---|---|---|---|---|
| | | | | | | | |
| 150 | 172 | 149 | 210 | 136 | 115 | 103 | 87.5 |
| 190 | 204 | 205 | 245 | 161 | 113 | 96.5 | 60 |
| 230 | 252 | 303 | 320 | 242 | 133 | 124 | 65 |
| 270 | 275 | 275 | 330 | 210 | 145 | 126 | 60 |
| 295 | 280 | 250 | 325 | 225 | 205 | 138 | 75 |
| 305 | 240 | 160 | 240 | 110 | 245 | 151 | 90 |
| 285 | 235 | 175 | 265 | 130 | 303 | 210 | 145 |
| 265 | 180 | 169 | 225 | 214 | 393 | 310 | 265 |
| | | | | | | | |

*Fig. 14F*

THREE LINE AUXILIARY DRIVE BY VALUE AFTER EDGE EMPHASIS

| | | | | | | | |
|---|---|---|---|---|---|---|---|
| | | | | | | | |
| | | | | | | | |
| 190 | 195 | 184 | 225 | 133 | 101 | 79.8 | 43.8 |
| 230 | 265 | 365 | 353 | 299 | 136 | 137 | 70 |
| 278 | 284 | 274 | 338 | 187 | 121 | 121 | 50 |
| 303 | 303 | 283 | 365 | 290 | 215 | 138 | 75 |
| 320 | 223 | 108 | 185 | 42.5 | 236 | 128 | 70 |
| 285 | 260 | 186 | 298 | 98 | 286 | 190 | 113 |
| | | | | | | | |
| | | | | | | | |

*Fig. 14G*

THREE LINE AUXILIARY DRIVE BY VALUE AFTER NORMALIZATION

| | | | | | | | |
|---|---|---|---|---|---|---|---|
| | | | | | | | |
| | | | | | | | |
| 190 | 195 | 184 | 226 | 137 | 101 | 79.8 | 43.8 |
| 230 | 265 | 365 | 351 | 285 | 136 | 137 | 70 |
| 278 | 284 | 274 | 337 | 195 | 121 | 121 | 46.9 |
| 303 | 303 | 283 | 361 | 268 | 215 | 138 | 84.4 |
| 320 | 223 | 108 | 186 | 73.1 | 236 | 128 | 73.1 |
| 285 | 260 | 186 | 298 | 89.3 | 286 | 190 | 134 |
| | | | | | | | |
| | | | | | | | |

*Fig. 14H*

IMAGE DISPLAY APPARATUS

This is a continuation of application Ser. No. 10/680,221, filed Oct. 8, 2003.

BACKGROUND OF THE INVENTION

1. Field of the Invention

This invention relates to an image display apparatus.

2. Description of the Related Art

In the past, as examples of a display apparatus, known are a structure which was described in JP-A-6-342636 gazette (Patent Reference 1), and a structure which was described in JP-A-8-212944 gazette (Patent Reference 2). Image display apparatuses in these references are configured in such a manner that a plurality of surface-conduction type electron emitting devices are wire-connected by a plurality of scan interconnections and a plurality of, modulation interconnections in a matrix shape.

And, in these image display apparatuses, a selection electric potential is applied to a predetermined scan interconnection, and a drive electric potential is applied to the plurality of modulation interconnections, respectively. And, by an electric potential difference of the selection electric potential and the drive electric potential (hereinafter, drive voltage), an electron emitting device is driven.

By this, display for one line in an image display apparatus is carried out. After that, furthermore, by switching over scan interconnections to be selected with predetermined scan frequency to carry out scanning in a vertical direction, image display for one frame is realized.

In the above-described structure which was described in Patent Reference 2, a display panel comprising a plurality of electron emitting devices which were wire-connected in a matrix shape is divided into two of an upper one and a lower one, and column modulating means and row interconnection selecting means are provided independently for respective upper half area and lower half area.

By this, row scanning frequency is shifted to low speed of ½, and row selection time is extended twice. And, by the suchlike shifting to low speed of the row scanning frequency, and extension of the row selection time, a brightness margin is parted into reduction of drive current, and reduced is lower brightness due to voltage drop which is generated by drive current flowing through a row interconnection.

Also, in JP-A-8-50462 gazette (Patent Reference 3), described is a flat type display apparatus. That is, described are such a structure that, firstly, after a scanning signal is applied to adjacent two rows simultaneously to have them driven, to two rows which are adjacent to those two rows, a scanning signal is applied simultaneously to have them driven, which process is repeated, and such a structure that, after a scanning signal is applied to adjacent three rows simultaneously to have them driven, a scanning signal is applied to a third row out of these three rows, another row which is adjacent to the third row but is not included in these three rows, and a row which is adjacent to another additional row at an opposite side of the third row simultaneously to have them driven, which process is repeated.

Also, in JP-A-8-331490 gazette (Patent Reference 4), disclosed is an image display apparatus. That is, disclosed is such a structure that, after a scanning signal was applied to two row interconnections, a scanning signal is applied simultaneously to one row interconnection out of those row interconnections, and another one row interconnection which is adjacent to this row interconnection and is not included in these two row interconnections, which process is repeated. In this Patent Reference 4, disclosed is such a structure that polarity of a scanning signal to a modulation signal is reversed sequentially.

Also, in JP-A-5-216433 gazette (Patent Reference 5), disclosed is a driving method of a plasma display panel. That is, disclosed is such a structure that scan electrodes for consecutive two rows are driven sequentially as one scanning unit. In this structure, it is such a structure that, in odd number fields and even number fields, scanning electrodes for two rows of one scanning unit which is driven simultaneously is shifted with one scanning electrode.

Also, in JP-A-2000-267624 gazette (Patent Reference 6), disclosed is such a structure that, in a matrix type display apparatus, correlation detection is carried out, and when it was detected that there is correlation, a plurality of rows are driven in all.

Also, in JP-A-2-5088 gazette (Patent Reference 7), disclosed is a control method of a matrix display screen which comprises a plurality of row conductors and a plurality of column conductors. That is, disclosed is such a structure that addressing signals, which are applied sequentially to the plurality of row conductors, are overlapped partially.

As an example of driving a plurality of lines simultaneously in a liquid crystal display, disclosed is a liquid crystal driving method which was described in U.S. Pat. No. 3,262,175 gazette (Patent Reference 8).

Also, in the above-described Patent Reference 6, disclosed is a driving circuit of a matrix type display apparatus. That is, in this Patent Reference 6, disclosed is such a structure that simultaneous driving is carried out only to a plurality of rows which have correlation.

Also, in Patent Reference 3, a flat type display apparatus is disclosed. In the display apparatus which was disclosed in this Patent Reference 3, disclosed is one in which each two lines are driven at the time of interlace driving, and edge emphasis is carried out.

SUMMARY OF THE INVENTION

An object of the invention is to provide an image display apparatus which can carry out preferred bright image display or image display with small irregularity of brightness, and also which is of long life.

Also, another object of this invention is to provide an image display apparatus which can change scanning conditions on the occasion of image display, and also carries out change of scanning conditions preferably.

Furthermore, another object of this invention is to provide an image display apparatus which is bright or has small irregularity of brightness, and which is capable of realizing display with precise gray range.

In order to accomplish the above-described objects, a first invention of this invention is an image display apparatus which comprises a plurality of display devices, a plurality of scan interconnections and a plurality of modulation interconnections, which configures a matrix interconnection for driving the plurality of display devices, a scanning circuit for applying a scanning signal to the scan interconnections, and a modulation circuit for applying a modulation signal to the modulation interconnections, wherein the scanning circuit is one which applies the scanning signals to a part and the plurality of scan interconnections out of the plurality of scan interconnections in one select period, and which applies the scanning signals, in a subsequent select period, to the plurality of scanning interconnections which were shifted with one scan interconnection portion from a group of scanning interconnections to which the scanning signals were applied in a previous select period, and is one which applies the scanning signals which has the same polarity as the modulation signal, in successive two select periods, to the scanning interconnection to which the scanning signals should be applied repeatedly, and wherein the output from the scanning circuit has a low level portion in which signal level is controlled to low level between the scanning signals which are applied repeatedly to the scanning interconnection.

In this first invention, the two scanning signals whose polarity to the modulation signal is of the same polarity satisfy the following conditions.

That is, in case that electric potential of the scanning signal in a certain select period is higher than electric potential of the modulation signal, a scanning signal in another select period in which polarities to the scanning signal and the modulation signal are of the same polarity is a scanning signal whose electric potential is higher than the modulation signal which is applied in this another select period.

Also, in case that electric potential of the scanning signal in a certain select period is lower than electric potential of the modulation signal, a scanning signal in another select period in which polarities to the scanning signal and the modulation signal are of the same polarity is a scanning signal whose electric potential is lower than the modulation signal which is applied in this another select period.

Also, by having a portion which is controlled to lower level between scanning signals which are applied to a certain scan interconnection successively, it is possible to control size of unnecessary excess voltage due to variation of signal level of the scan interconnection, or the number of its application, which occurs by influence of commencement of application, or termination of application of the scanning signal to the scan interconnections which are adjacent or close to each other, which occurs in a period of this low level.

That is, when successive scanning signals are applied without disposing a portion which is controlled to low level, there occurs commencement or termination of application of a scanning signal to scan interconnections which are adjacent or close to each other between it, and it comes under the influence of cross talk due to its variation of electric potential.

Also, according to this first invention, since disposed is the portion which is controlled to low level, if at least a part, and preferably a substantially entirety of a period of electric potential variation in this adjacent or close scan interconnections is overlapped in this period of low level, due to commencement or termination of the scanning signal to the adjacent or close scan interconnections, it is possible to suppress influence of cross talk due to its electric potential variation.

That is, it is fine if the low level in this invention is level which is close to signal level (reference electric potential) which does not come under the influence of application of scanning signals in close scan interconnections to which scanning signals are not applied.

Also, preferably, it is preferred that it is a value which approaches to the reference electric potential side rather than the maximum value by at least half value of an electric potential difference of a maximum value and a reference electric potential. Particularly, it is preferred that the reference electric potential is adopted as the low level. In addition, here, what is called as the low level is a relative one, and it does not mean only a condition that it is lower than electric potential of the scanning signal.

That is, in case that electric potential of the scan interconnection when the scanning signal is applied is higher than electric potential of the scan interconnection when the scanning signal is not applied, the low level means electric potential which is lower than electric potential of the scanning signal. On the other hand, in case that electric potential of the scan interconnection when the scanning signal is applied is lower than electric potential of the scan interconnection when the scanning signal is not applied, the low level means electric potential which is higher than electric potential of the scanning signal.

Also, in this invention, preferably, it is possible to adopt a structure having a control circuit for controlling a scanning circuit in such a manner that it carries out scanning by any one of scanning conditions of such a first scanning condition that, to a plurality of scan interconnections which were shifted with one scan interconnection portion from a plurality of scan interconnections to which the scanning signal applied in a previous select period, in successive select periods, the scanning signal is applied in a subsequent select period, and such a second scanning condition which is different from the first scanning condition as to the number of the scan interconnections to which the scanning signal is applied simultaneously in one select period, or the number of the scan interconnection to which the scanning signals are applied successively in successive two select periods, or both of the number of the scan interconnections to which the scanning signal is applied simultaneously in one select period and the number of the scan interconnections to which the scanning signals are applied successively in successive two select periods.

Here, it is possible to change display by the first scanning condition and display by the second scanning condition in the course of displaying one screen. Also, it is desirable that this change is carried out between substantial screen display and next substantial screen display. Here, as a structure for carrying out change of a scanning condition between the substantial screen display and the next substantial screen display, it is possible to preferably adopt such a structure for carrying out the change during a period until scanning is started from a first end side again for next desired screen display, after a desired screen was displayed by carrying out scanning from a one side (first end) out of all scan interconnections which configure a matrix interconnection (it may not be from a most end scan interconnection of the one end) to its opposite end (it may not be to a most end scan interconnection of the opposite end). In addition, as the second scanning condition, a scanning condition for carrying out interlaced scanning of the scan interconnections can be taken. In this case, in case that one screen is displayed by the scanning condition, all scan interconnections are not scanned. That is, display of one screen is not limited to carrying out display by scanning all scan interconnections.

Also, as a structure for carrying out the change of the scanning condition during a period until the next substantial screen is displayed, after one substantial screen was displayed, when a series of screens are displayed by a predetermined surface frequency (e.g., in case that 60 screens are displayed for one second, the surface frequency becomes 60 Hz), it is preferable that change of the scanning condition, in case that the surface frequency was not changed prior to change of the scanning condition, is completed until time when scanning for displaying a next screen should be started, and is carried out without delaying commencement of the scanning for screen display after change of the scanning condition. Also, beside this structure, it is possible to adopt a structure for carrying out change of the scanning condition in the intervening period, by having commencement of scanning for next screen display delayed. And, during such a period that commencement of scanning for the next screen display is delayed, it is fine if the modulation signal is not also made to be applied.

Also, when the scanning condition is changed, it may be designed not to carry out substantial screen display which is screen display due to a signal which is inputted from outside an image display apparatus. That is, it may be designed to carry out uniform display such as black display (display operation which is carried out without inputting the modulation signal), gray display etc., such display that information is displayed only on a part of a screen by a signal outputted from a signal source such as a ROM etc. which is disposed in an image display apparatus and uniform display such as gray etc. is applied to other portion (these are called as insubstantial display), and so on. If it is designed to occur change of the scanning condition in a uniform display portion by these insubstantial displays, uncomfortable feeling due to change of the scanning condition is suppressed.

Also, in an image display apparatus according to the above-described invention, preferably, it is possible to adopt a structure which has a plurality of signal input terminals, and in which the control circuit selects to carry out display based upon a signal from, which signal input terminal out of the plurality of signal input terminals, and which controls the scanning circuit by a scanning condition which responds to the signal input terminal selected out of a plurality of scanning conditions including at least the first scanning condition and the second scanning condition.

Also, in respective inventions as above, the scanning circuit can, preferably, adopt such a structure that scanning signals with different electric potentials were designed to be applied to a plurality of row interconnections which are selected in one select period. Here, it is more preferable that the scanning circuit is configured in such a manner that different are scan interconnections to which a scanning signal with the highest level in successive respective select periods is applied. In addition, the highest level means electric potential with an electric potential difference from electric potential of the modulation signal.

In addition, there is a case that clarity of an edge of an image to be displayed is damaged, by carrying out display of the plurality of scan interconnections in one select period, with application of the scanning signal. In this connection, it is possible to compensate reduction of clarity of the edge by carrying out edge emphasis. In addition, according to this invention, although adopted is a structure of applying the scanning signal to the plurality of scan interconnections in one select period, a shifted amount of the scan interconnection is made to be one scan interconnection in successive select periods, and for that reason, there is such a case that an edge may not be emphasized according to an image to be displayed, or level of correction for the emphasis may be lowered. In this connection, it is desirable to enable selection of application/non-application of correction for the edge emphasis, and/or selection of level of correction for the edge emphasis to be applied.

A second invention of this invention is an image display apparatus which comprises a plurality of display devices, a plurality of scan interconnections and a plurality of modulation interconnections, which configures a matrix interconnection for driving the plurality of display devices, a scanning circuit for outputting scanning signals sequentially with scanning the plurality of scan interconnections, a control circuit for controlling the scanning circuit in accordance with one scanning condition out of a plurality of scanning conditions which are different from each other, as to the number of the scan interconnections which are selected simultaneously in each select period, or the number of the scan interconnections to which the scanning signals are applied repeatedly in successive two select periods, or both of the number of the scan interconnections which are selected simultaneously in each select period and the number of the scan interconnections to which the scanning signals are applied repeatedly in successive two select periods, and a modulation circuit for applying a modulation signal to the modulation interconnection, wherein the control circuit carries out change of the scanning condition, during a period after one substantial screen was displayed, until a next substantial screen is displayed.

A third invention of this invention is an image display apparatus which comprises a plurality of display devices, a plurality of scan interconnections and a plurality of modulation interconnections, which configures a matrix interconnection for driving the plurality of display devices, a scanning circuit for outputting scanning signals sequentially with scanning the plurality of scan interconnections, a control circuit for controlling the scanning circuit in accordance with one scanning condition out of a plurality of scanning conditions which are different from each other, as to the number of the scan interconnections which are selected simultaneously in each select period, or the number of the scan interconnections to which the scanning signals are applied repeatedly in successive two select periods, or both of the number of the scan interconnections which are selected simultaneously in each select period and the number of the scan interconnections to which the scanning signals are applied repeatedly in successive two select periods, a modulation circuit for applying a modulation signal to the modulation interconnection, and a plurality of signal input terminals to which signals are inputted, respectively, wherein the control circuit controls the scanning circuit by a scanning condition, which responded to the signal input terminal from which signals to be displayed are inputted, which was selected out of a plurality of scanning conditions.

A fourth invention of this invention is an image display apparatus which comprises a plurality of display devices, a plurality of scan interconnections and a plurality of modulation interconnections, which configures a matrix interconnection for driving the plurality of display devices, a scanning circuit for outputting scanning signals sequentially with scanning the plurality of scan interconnections, a modulation circuit for applying a modulation signal to the modulation interconnection, wherein the scanning circuit is one which applies the scanning signals to a plurality of adjacent scan interconnection in one select period and applies the scanning signals to a plurality of scan interconnections which were shifted with one scan interconnection portion from the plurality of scan interconnections to which the scanning signals were applied in a previous select period, in a subsequent select period, and the modulation circuit is one which applies a pulse width modulation signal to the modulation interconnection, and applies one pulse width modulation signal in one select period.

According to this invention, it is possible to realize preferred display by such a design that one pulse width signal which is generated from one gray scale data does not straddle a plurality of select periods.

In addition, in the above-described first through fourth inventions, as the display device, various structures can be adopted. Concretely speaking, to the above-described first through fourth inventions, it is possible to use a device which is driven by an electric potential difference of electric potential of the scanning signal and electric potential of the modulation signal. As the suchlike device, concretely speaking, an electron emitting device can be cited. It is possible to display an image, by use of a luminous body which emits light with irradiation of electrons which were emitted from the electron emitting device, together with the electron emitting device.

Also, in this invention, as the display device, an electroluminescence device can be used. Also, it is possible to use a liquid crystal and a pair of electrodes for applying voltage to this liquid crystal as the display device. Also, a pair of electrodes which configure a pixel in a plasma display correspond to ones which configure the display device here. In addition, in a structure of using a switching device for display, it is possible to realize the invention of this application by using the switching device as one which configures the display device here. As this switching device, preferably, it is possible to adopt a transistor whose On/OFF are controlled by the scanning signal.

BRIEF DESCRIPTION OF THE DRAWINGS

The invention, together with further advantages thereof, may be best be understood by reference to the following description taken in conjunction with the accompanying drawings in which:

FIGS. 10A to 10H are tables representing correlation of data processing and output luminance according to the sixth embodiment of this invention;

FIGS. 12A to 12H are tables representing correlation of data processing and output luminance according to the eighth embodiment of this invention;

FIGS. 14A to 14H are tables representing correlation of data processing and output luminance according to the tenth embodiment of this invention;

DESCRIPTION OF THE PREFERRED EMBODIMENTS

Hereinafter, preferred embodiments of this invention will be described in detail in an illustrated manner with reference to the drawings. In this regard, however, there is no such effect that dimensions, materials, shapes of components which are described in this embodiment, relative configuration thereof and so on, unless there is particularly specific description, are ones which restrict a scope of this invention only to them.

As to a plurality of the above-described invention, hereinafter, concrete embodiments thereof will be described. In addition, requirements of respective inventions and embodiments thereof are ones which can be used by combining them, respectively.

Firstly, a committed study which reached to thinking out this invention by an inventor of this invention will be described. That is, the inventor of this invention devoted himself to study in order to accomplish the above-described various objects. Hereinafter, a summary thereof will be described.

That is, the inventor of this invention found out that particularly preferred display is possible by making a structure of applying a scanning signal to a plurality of scan interconnection which are adjacent to each other with respect to each select period, and further, by adopting a structure of shifting a group of scan interconnections to which the scanning signal is applied, with one scan interconnection, every time the select period is changed.

Figure 17:
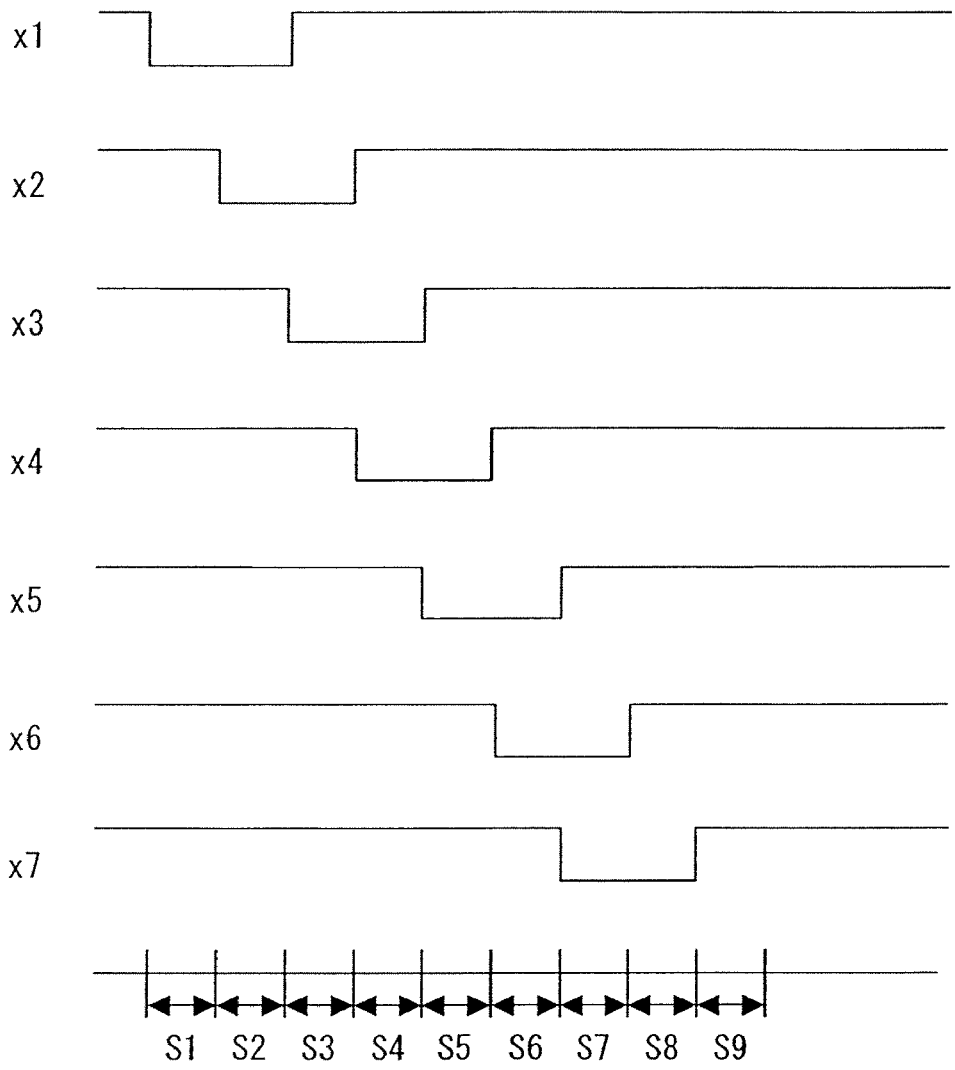
FIG. 17 is a schematic diagram for explaining problems of an image display apparatus according to a conventional technology.

Hereinafter, as a structure regarding each invention which relates to this application, a structure for carrying out this scanning will be illustrated. Concretely speaking, for example, it is such a structure that, to two, first and second scan interconnections, a scanning signal is applied in a certain select period, and in a subsequent select period, a scanning signal is applied to the second scan interconnection, and a third scan interconnection which is adjacent to an opposite side of the first scan interconnection to the second scan interconnection. One example of this structure is shown in FIG. 17.

For example, in a select period S3, a scanning signal is applied to two scan interconnections X2 and X3, and in a subsequent select period S4, a scanning signal is applied to two scan interconnections X3 and X4, which were shifted with one scan interconnection portion from a group of the scan interconnections X2 and X3.

Furthermore, the inventor of this invention, as a result of the committed study, found that there occurs a particular problem, in such a structure that a scanning signal is applied to a plurality of scan interconnections with respect to each suchlike select period, and further, a group of scan interconnections to which a scanning signal is applied every time the select period is changed, is shifted with one scan interconnection portion. One concrete example of this particular problem will be described with reference to FIG. 17.

A scanning signal is to be applied to respective scan interconnections, over a plurality of select periods. Focusing on X3, signal level of X3 is influenced, by rising of signal level of X4, at the time of transition from a select period S3 to S4, i.e., by change from such a situation that a scanning signal is not applied to X4 to such a situation that the scanning signal is applied thereto.

Also, it is influenced by falling of signal level of X2, at the time of transition from the select period S3 to S4, i.e., by change from such a situation that a scanning signal is applied to X2 to such a situation that the scanning signal is not applied thereto.

In other words, level of a signal which is applied to a certain scan interconnection is fluctuated by rising and falling of a signal in an adjacent scan interconnection. If this variation occurs when the scanning signal is applied, the variation is added to signal level of the scanning signal so that unnecessary voltage is applied.

The inventor of this invention reached to such a knowledge that influence due to this phenomenon is generated extremely notably, as compared with influence due to the phenomenon in such a structure that it is configured to apply a scanning signal simultaneously to two scan interconnections and, a next group of scan interconnections are selected by shifting them with two scan interconnections in a subsequent select period.

Also, this phenomenon is not one which is generated limiting to a structure for applying a scanning signal simultaneously to two scan interconnections, but is one which is generated even in a structure for applying the scanning signal to three and more scan interconnections in one select period.

Concretely speaking, for example, considered is such a structure that a scanning signal is applied to three scan interconnections of first, second and third scan interconnections in a certain select period, and in a subsequent select period, a scanning signal is applied to the second and third scan interconnections and a fourth scan interconnection which is adjacent to the third scan interconnection at an opposite side to the second scan interconnection. One example of this structure is shown in FIG. 18.

Figure 18:
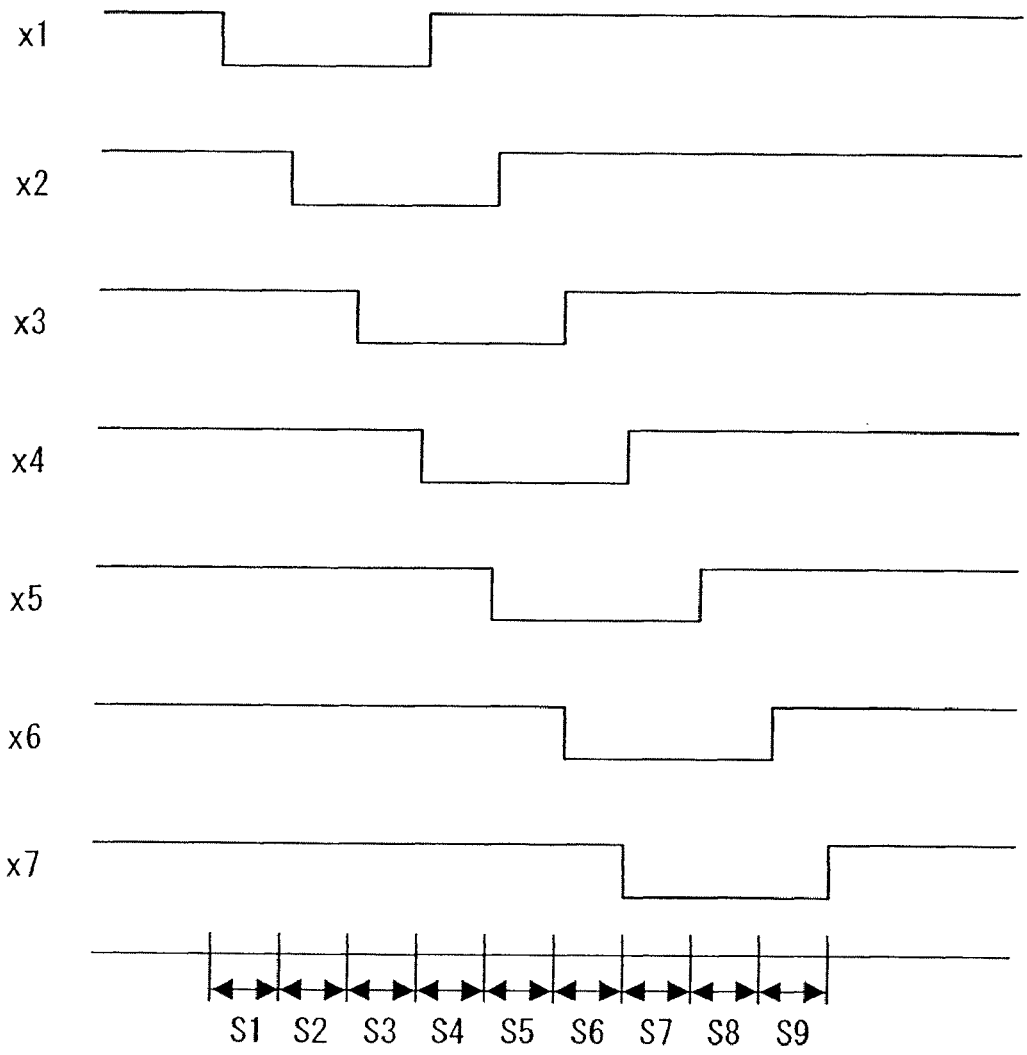
FIG. 18 is a schematic diagram for explaining problems of an image display apparatus according to a conventional technology.

That is, as shown in FIG. 18, in a select period S3, a scanning signal is applied to three scan interconnections of X1, X2 and X3, and in a subsequent select period S4, a scanning signal is applied to scan interconnections X2, X3 and X4 which were shifted with one scan interconnection portion from a group of X1, X2 and X3.

Focusing on X3, signal level of X3 is influenced by rising of signal level of X4 at the time of transition from the select period S3 to S4, i.e., by change of such a situation that a scanning signal is not applied to X4 to such a situation that the scanning signal is applied. Also, at the transition from the select period S4 to S5, by falling of signal level of X2, i.e., by change of such a situation that the scanning signal is applied to X2 to such a situation that the scanning signal is not applied, it is influenced. Also, although they are not adjacent scan interconnections, by rising and falling of signal levels of X1, X5 which are scan interconnections adjacent to the second one, it is also influenced.

That is, level of a signal which is applied to a certain scan interconnection is fluctuated several times by rising and falling of a signal in an adjacent scan interconnection. Since this variation is generated when a scanning signal is applied, the variation is added to signal level of the scanning signal so that unnecessary voltage is applied.

The influence due to the above-described phenomenon in the suchlike structure occurs notably as compared with influence due to the phenomenon in such a structure, as a structure for applying a scanning signal simultaneously to three scan interconnections, that, in a subsequent select period, they are shifted with two scan interconnections or three scan interconnections, and a group of next scan interconnections are selected.

As above, the inventor of this invention reached to finding the particular problem as described above. In this connection, the inventor of this invention devoted himself to study as to a structure which is capable of solving this particular problem, and found one invention out of these inventions. Concretely speaking, he reached to figuring out a structure for disposing a portion which is controlled to low level between scanning signals which are applied successively.

Also, the inventor of this invention focused on such a scanning condition, as a particularly preferred scanning condition, that a scanning signal is applied simultaneously to two scan interconnections, and subsequently, a scanning signal is applied to two scan interconnections which were shifted with one scan interconnection portion from these two scan interconnections.

This scanning condition is a particularly excellent scanning condition which can satisfy both of brightness and resolution at high level in one screen display.

Also, the inventor of this invention devoted himself to study as to a structure for carrying out pulse width modulation as a modulation method. Concretely speaking, he devoted himself to study diversely as to a structure for applying a modulation signal with pulse width according to a luminous signal to be inputted to a display device, and a structure for applying a modulation signal in which both of pulse width and a wave height value were changed according to a luminous signal to be inputted to a display device.

That is, firstly, on the occasion of carrying out precise gray scale display, the pulse width modulation is an excellent technology. Here, known is a structure which was described in the above-described Patent Reference 7 in the past.

In this Patent Reference 7, shown is such a structure that, simultaneously to two row conductor, Vmax as an addressing signal is applied, and subsequently, simultaneously to two row conductor which was shifted with one row, Vmax is applied. Furthermore, disclosed is a structure for selecting each pixel from two conditions of turning-on and turning-off by application of a signal to a row conductor, in this structure.

However, in Patent Reference 7, a structure for applying Vmax as the addressing signal simultaneously to two row conductor and subsequently, for applying Vmax simultaneously to two row conductors which were shifted with one row, and a structure for carrying out gray scale display are not shown.

Furthermore, in the structure of Patent Reference 7, if the pulse width modulation is adopted, there occurs such a problem that fluctuated are rows which emit light at the same time depending upon pulse width of the modulation signal.

The inventor of this invention, having found out the particular problem as above, devoted himself to study, and as a result, reached to figuring out the invention which can solve the particular problem, In embodiments which will be described below, as a best embodiment of this invention, a structure which can solve a plurality of problems at the same time will be illustrated. Also, a plurality of inventions which relates to this application are ones which is capable of working independently, respectively. Also, hereinafter, concrete examples of requirements of respective inventions will be shown as embodiments, but it is possible to use requirements in one invention also as requirements of another invention by combination.

First Embodiment

Figure 1:
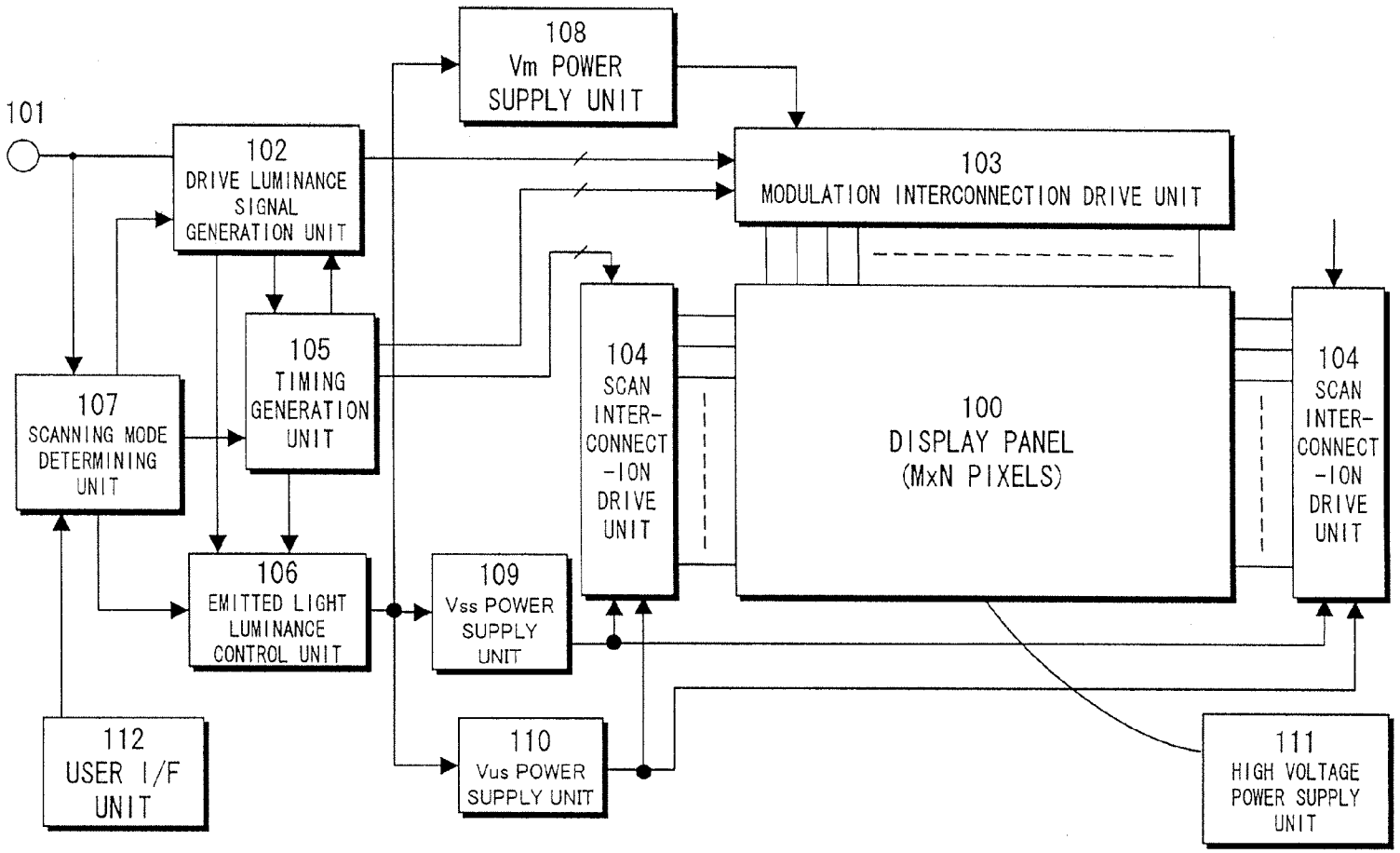
FIG. 1 is a block diagram showing a structure of an image display apparatus according to a first embodiment of this invention.

Firstly, an image display apparatus according to a first embodiment of this invention will be described. FIG. 1 shows an image display apparatus of this first embodiment. In addition, the image display apparatus of this first embodiment is preferable to be used in, for example, a display apparatus for displaying image signals (video signals) such as TV signals, image output signals of a computer etc., and so on.

In addition, in this first embodiment, it will be described by citing an image display apparatus which used a surface conduction type electron emitting device as an example, but this invention is also applicable preferably to an image display apparatus and so on which used a cold cathode type electron emitting device such as a FE type device, a MIM device etc., an EL device and so on.

As shown in FIG. 1, a display panel 100 is configured by a multiple electron beam source in which surface conduction type devices are wired in a matrix shape of MXN pixels, and a fluorescent surface which receives an electron beam emitted from this multiple electron beam source to emit light.

Also, a high voltage power supply unit 111 is one for applying high voltage bias, which becomes acceleration voltage for accelerating the emitted electron beam to the fluorescent surface.

Also, as described in Patent Reference 1, conceivable are several emitted light luminance gray scale control methods in a display panel which used the surface conduction type device.

In the image display apparatus according to this first embodiment, disposed is a modulation interconnection drive unit 103 which is a modulation circuit for applying voltage pulse having pulse width according to luminous data which defined respective pixel emitted light amount as a pulse width modulation signal to a row interconnection.

On the other hand, a scan interconnection drive unit 104 which is a scanning circuit applies a selection voltage pulse which is a scanning signal to a scan interconnection to which a display device for emitting light is connected, and applies non-selection voltage to a non-selection line (non-selection scan interconnection) to scan rows which are selected sequentially.

Adopted is a so-called pulse width modulation and line sequential drive system that a device is to be driven by applying an electric potential difference of electric potential of a voltage pulse of a modulation signal and electric potential of a selection voltage pulse of a scanning signal to a display device, and image display is carried out by use of a pulse width modulation signal whose pulse width was modulated as a modulation signal.

Also, a Vm power supply unit 108 is a power supply for determining electric potential of an output voltage pulse of the modulation interconnection drive unit 103. Also, a Vss power supply unit 109 is a power supply for determining electric potential of a selection voltage pulse which is outputted to the scan interconnection drive unit 104. Also, a Vus power supply unit 110 is a power supply for determining electric potential of a non-selection voltage pulse which is outputted to the scan interconnection drive unit 104.

Also, the scan interconnection drive unit 104 comprises SW devices, the number of which is the same as the number of panel row interconnections (scan interconnections), and a scanning signal generation unit which supplies scanning signals for showing selection and non-selection to this SW device. And, this scan interconnection drive unit 104, at the time of selection, applies voltage which is supplied from the Vss power supply unit 109 to scan interconnections of the display panel 100, and at the time of non-selection, applies voltage which is supplied from the Vus voltage unit 110 to the scan interconnections of the display panel 100.

Also, an input terminal 101 is an input part for receiving a video signal input from outside. In addition, the input terminal 101 includes decode means for expanding a compressed signal to demodulate an original signal in case that an input video signal is inputted in the compressed form from an original signal, for supplying a video signal in a restricted transmission band.

Also, a video signal which is inputted to the input terminal 101 is supplied to a drive luminous signal generation unit 102.

In this drive luminous signal generation unit 102, an image signal from the input terminal 101 is sampled so as to be in conformity with the number of devices of the display panel 100 and a pixel structure. And, from this input image signal, generated is luminance data which corresponds to electron beam emission amount desired value data in respective pixels of the display panel 100

Also, with regard to the number of vertical lines, in case that the number of effective display scan lines of the input video signal is different from the number of display row lines (the number of scan interconnections) of the display panel 100, carried out is scan line number conversion processing by use of scaling processing such as scan line interpolation etc. And, a drive luminance signal, which is in conformity with the number of display row lines of the display panel 100, is outputted. This scaling processing ration is given in an adaptive manner by a scanning condition determining unit 107 which is a control circuit.

Also, as to the luminance data generated, a luminance data row for one row is supplied to the modulation interconnection drive unit 103 to be capable of being displayed in synchronous with selection scanning of row interconnections to be displayed. Here, one line scanning period corresponds to one select period. At the time of starting the select period, disposed is a low level control portion for one clock, and after that, a scanning signal is applied.

Also, the modulation interconnection drive unit outputs a pulse width modulation signal so as for the pulse width modulation signal to be accommodated in one select period. Concretely speaking, application of the pulse width modulation signal is started in synchronous with commencement of the select period. In addition, since disposed is a portion in which signal level of a scan interconnection which was selected at the time of starting the select period becomes low level, and after that, the scanning signal is applied, in order for application of the pulse width modulation signal to be initiated at the same time as application of the scanning signal, the pulse width modulation signal is also applied with one clock delayed from commencement of the select period.

Also, there are many cases that the image signal premises a display apparatus which adopted a CRT. On that account, there are many cases that gamma correction is applied to the image signal, considering a gamma characteristic that the CRT has.

In this connection, in case that emitted light luminance is intended to a display panel which is almost proportional to the electron beam emission amount desired value data, in the drive luminance signal generation unit 102, so-call inverse gamma correction for canceling out this gamma correction is carried out.

And, this drive luminance signal generation unit 102 separates a synchronous signal which is included in an input image signal, from an image signal and supplies it to a timing generation unit 105.

The timing generation unit 105 which received the synchronous signal generates CLK signals which are necessary for signal processing, such as data sampling in the drive luminance signal generation unit 102, luminance data row transfer to the modulation interconnection drive unit 103 and so on. The CLK signals generated are supplied to the drive luminance signal generation unit 102 and the modulation interconnection drive unit 103.

Also, the timing generation unit 105 which received the synchronous signal generates a start trigger signal for row scanning commencement for row scanning and line CLK signals for changing selection lines sequentially, and supplies them to the scan interconnection drive unit 104.

Also, an emitted light luminance control unit 106 gives variation to output voltage of the Vss power supply unit 109, the Vm power supply unit 108 or the Vus power supply unit 110. By this, by the emitted light luminance control unit 106, controlled is an electron beam emission amount in respective pixels of the display panel 100, and as a result, emitted light luminance of the display panel 100 is variably controlled.

Also, a user interface unit 112 is, for example, a switch etc. which is equipped with remote controller, or an image display apparatus. That is, the user interface unit 112 is one for transmitting an operation information input which is operated by a use of an image display apparatus to the scanning condition determining unit 107.

Also, the scanning condition determining unit 107 is a scanning control unit which is equipped for switching scanning methods in one frame period. And, the scanning condition determining unit 107 controls the scan interconnection drive unit by supplying an instruction signal for determining the number of rows which are simultaneously selected in one scanning unit (one select period), and a scanning area of respective scanning units, concretely speaking a scan commencement position and a scan completion position (depending upon an image to be displayed, since there is a case to display without using partial scan interconnections of an upper part and a lower part of the display panel or of both of them) to the timing generation unit 105.

Also, the scanning condition determining unit 107 supplies a signal representing a scaling processing ratio to the drive luminance signal generation unit 102, so as to be in conformity with the determined scanning condition and the drive luminance signal which is inputted to the modulation interconnection drive unit 103.

As above, this image display apparatus according to the first embodiment is configured.

Figure 2:
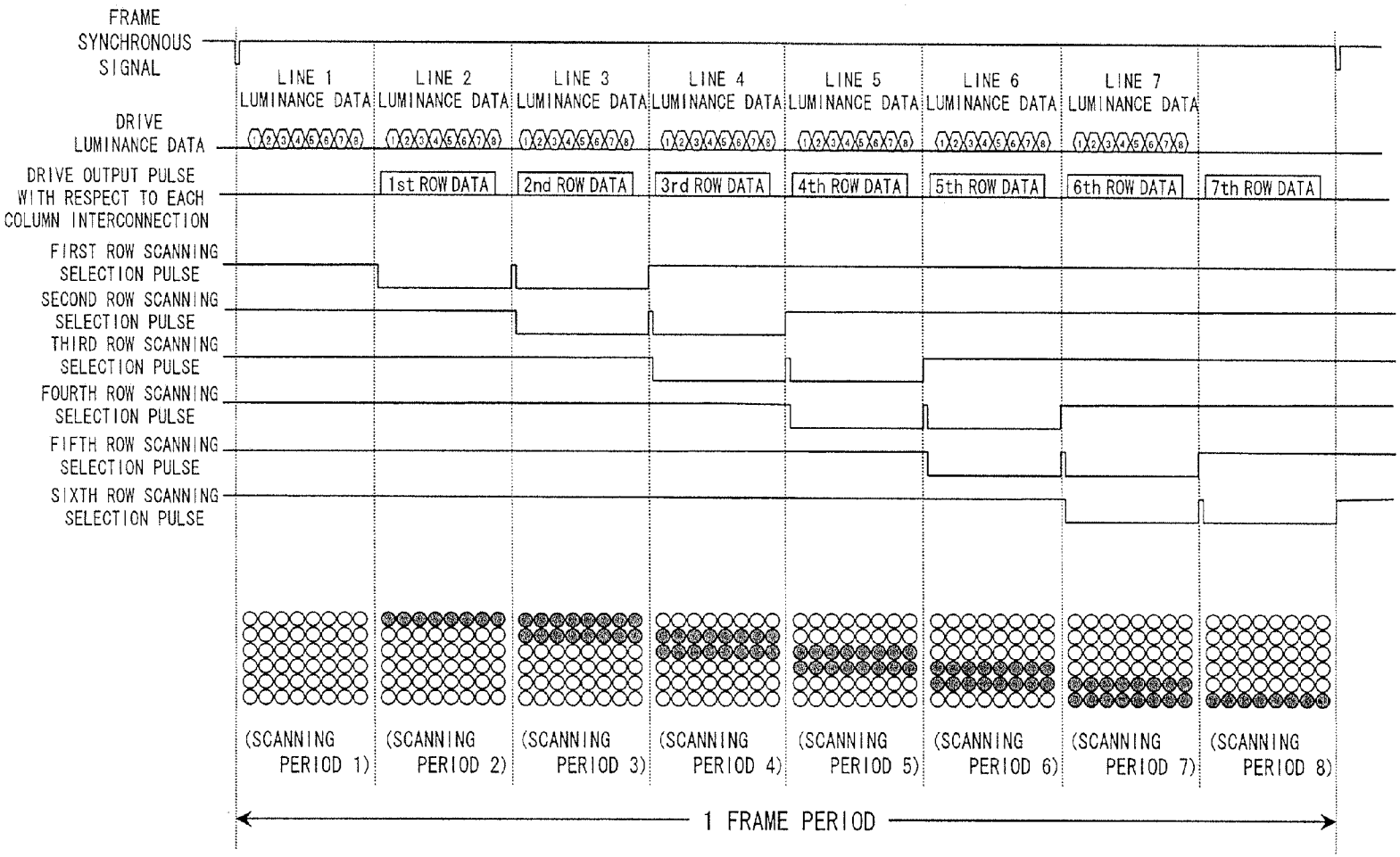
FIG. 2 is a timing chart showing a scanning sequence of a row interconnection according to the first embodiment of this invention.

Next, in the image display apparatus which was configured as above, a predetermined scanning condition will be considered. An example of this scanning condition is shown in FIG. 2. FIG. 2 is a timing chart regarding scanning of the scan interconnections in the image display apparatus shown in FIG. 1. In addition, in this first embodiment, in order to facilitate understanding, the display panel 100 is to be configured from pixels which were connected by a matrix interconnection of 8 columns×6 rows.

That is, in this first embodiment, one frame period is configured by eight scanning periods (select periods), and in synchronous with this scanning period, luminance data which defined emitted light amount of respective pixels is inputted to the modulation interconnection drive unit 103 one line by one line.

The modulation interconnection drive unit 103 to which the luminance data was inputted holds this input luminance data for one scanning period. And, with respect to each scanning period, and with respect to each modulation interconnection, a voltage pulse, which is a modulation signal having pulse width which is proportional to size of the luminance data, is outputted for driving the modulation interconnection.

Also, a scan interconnection selection sequence with respect to each scanning period in one frame period is defined as follows.

Firstly, a first scanning period is assigned to a non-display period. In a second scanning period, selection electric potential, which is a scanning signal, is given to a first row of the scan interconnections, and an opportunity of light emission is given to a first row of pixels. In a third scanning period, selection electric potential is given to first and second rows of the scan interconnections, and an opportunity of light emission is given to first and second rows of the pixels. In a fourth scanning period, selection electric potential is given to second and third rows of the scan interconnections, and an opportunity of light emission is given to second and third rows of the pixels. In addition, the pixels are ones which are formed by such an operation that display devices are driven. Concretely speaking, image display is carried out by use of luminescent spots, which are formed by light emission of each display device, as pixels.

Also, in a fifth scanning period, selection electric potential is given to third and fourth rows of the scan interconnections, and an opportunity of light emission is given to third and fourth rows of the pixels. In a sixth scanning period, selection electric potential is given to fourth and fifth rows of the scan interconnections, and an opportunity of light emission is given to fourth and fifth rows of the pixels. In a seventh scanning period, selection electric potential is given to fifth and sixth rows of the scan interconnections, and an opportunity of light emission is given to fifth and sixth rows of the pixels. In an eighth scanning period, selection electric potential is given to a sixth row of the scan interconnections, and an opportunity of light emission is given to a sixth row of the pixels.

In the example shown in FIG. 2, used is such a scanning condition that the scanning condition determining unit 107 applies a scanning signal to two scan interconnections so as to give an opportunity of light emission simultaneously to two rows of the pixels in a single scanning unit, and in a next scanning unit, applies a scanning signal to scan interconnections which correspond to the two rows, so as to give an opportunity of light emission to two rows of the pixels which were shifted with one row from the two rows, i.e., that, to one row out of two rows to which an opportunity of light emission was given in a previous select period, an opportunity of light emission is given also in a next select period.

Figure 3:
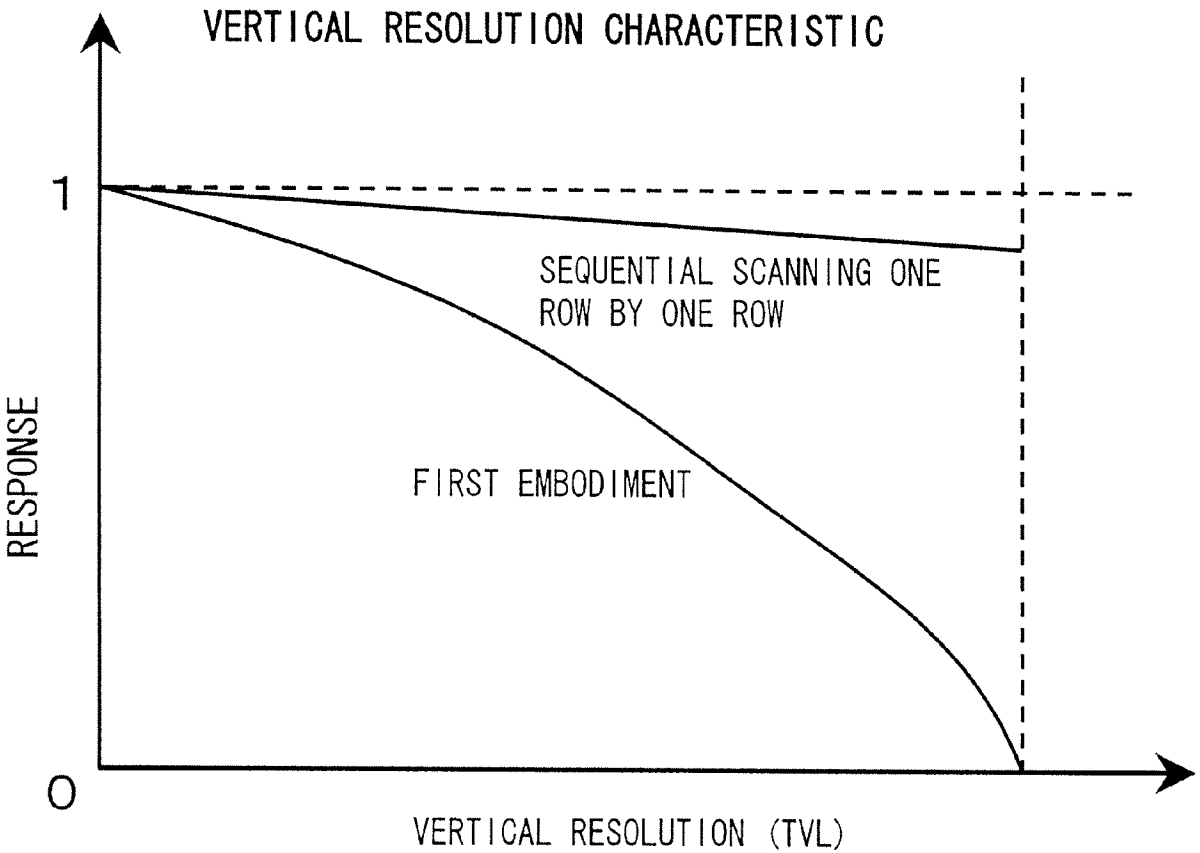
FIG. 3 is a graph showing resolution relativity of response according to the first embodiment of this invention.

Next, shown in FIG. 3 is a vertical resolution characteristic in case that image display was carried out by a method for carrying out line sequential driving one line by one line, and such a scanning method that an opportunity of light emission is given simultaneously to two rows of the pixels according to this first embodiment, and one row of display pixels is overlapped between a certain scanning unit and a next scanning unit.

As shown in FIG. 3, by adopting the scanning method according to this first embodiment, it can be seen that it becomes possible to suppress a response in a high area, and it becomes possible to reduce aliasing distortion in the high area. That is, it becomes possible to reduce so-called moire, which is generated in a display image.

As above, by adopting such a scanning method that two rows of the pixels are made to emit light at the same time in a single scanning unit, and one row of display pixels is overlapped between this scanning unit and a next scanning unit, by shifting a selected scan interconnection with one scan interconnection, as compared with a system for scanning light emission lines sequentially one line by one line, it becomes possible to set respective selection time in one frame period to length of two times. By this, it becomes possible to make emitted light luminance in the display panel 100 approximately two times.

Also, as described above, by setting electron beam irradiation time to a fluorescent surface to length of tow times, it becomes possible to realize high luminance. In the meantime, on the other hand, depending upon type of a fluorescent material which is used, electron beam current density and length of irradiation time, a relation of length of beam irradiation time to the fluorescent surface and emitted light luminance is not necessarily limited to a linear shape. In this connection, in this first embodiment, by correcting with addition of this non linearity to inverse gamma correction which is carried out in the drive luminance signal generation unit 102, it becomes possible to obtain a favorable light emission characteristic.

Also, in the example shown in FIG. 2, scanning signals are applied to respective scan interconnection, during successive two scanning periods, and, between scanning signals which are successively applied to one scan interconnection, a low level control portion for one clock is disposed. Here, as the low level, given is the same electric potential as the non-selection electric potential given to a scan interconnection to which a scanning signal is not applied.

More concretely speaking, it is designed in such a manner that application of a scanning signal to a scan interconnection to which the scanning signal is given successively is made to be terminated once, together with termination (to a scan interconnection which is adjacent to this screen upper side, a scanning signal is not applied in a subsequent select period) of application of a scanning signal to a scan interconnection which is adjacent to a screen upper part thereof (which is mentioned in such a situation that a scan interconnection for starting scanning is located at a top), and the low level control portion for one clock is disposed, and at the same time of commencement (to a scan interconnection which is adjacent to this screen lower side, a scanning signal is not applied in a select period right before this) of application of a scanning signal to a scan interconnection which is adjacent to a screen lower side, application of a scanning signal is started again.

This is because, if switching of selection and non-selection of another row (commencement or termination of application of a scanning signal) is carried out when a scanning signal is applied to a certain predetermined scan interconnection, ON, OFF switching noises due to this switching barge into a scanning signal which is applied to the predetermined scan interconnection, and such a possibility that excess voltage is applied to display devices is reduced.

Also, in case that, not for the purpose of increasing emitted light luminance, without changing the emitted light luminance of the display panel 100, the electron emission amount of respective pixels is reduced with an elongated portion of respective pixels selection time in one frame period, it can be realized by the same structure.

Figure 4:
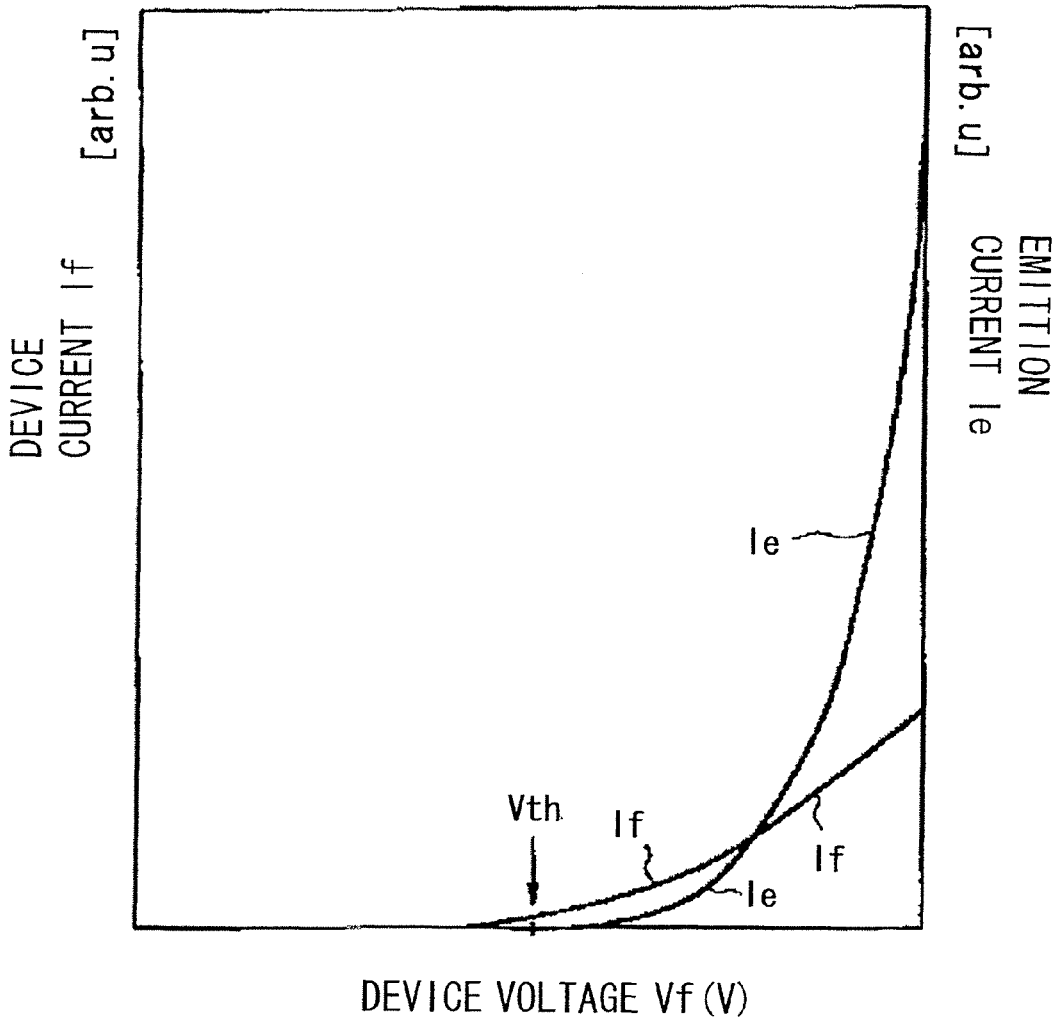
FIG. 4 is a graph showing device voltage relativity of device current and emission current.

Concretely speaking, one example of a drive voltage—electron emission amount characteristic of an electron emission device which was used in this embodiment is shown in FIG. 4. On the basis of the characteristic of the suchlike electron emission device, even if drive voltage is set in such a manner that an electron emission amount becomes approximately ½, by use of the scanning condition according to this first embodiment, emitted light luminance of this display panel 100 becomes almost equivalent to a structure for scanning one line by one line with setting of the drive voltage in such a manner that the electron emission amount becomes two times thereof.

Also, as apparent from a characteristic chart shown in FIG. 4, in case that a device drive voltage was reduced, it is possible to also reduce device drive current together with the electron emission amount.

That is, according to the first embodiment of this invention, by applying a scanning signal to a plurality of scan interconnections in one select period, it becomes possible to reduce drive current of a row interconnection, over improving brightness or maintaining brightness.

Also, in case that the amount of current flowing through a scan interconnection was reduced, it is possible to reduce voltage drop which occurs on a scan interconnection. By reducing the voltage drop, it becomes possible to mitigate non-uniform luminance lowering due to voltage drop.

Also, in the above-described first embodiment, described was the example in which pixels of the display panel 100 are connected by matrix interconnections of 8 column×6 rows, but a display panel which is figured out by a technical concept of this invention has the number of pixels which enables high image quality display of a high definition input image.

And, it is applicable to a display panel of high number of pixels in the same manner, but not limited to the number of pixels of the display panel 100 according to this first embodiment, and furthermore, this technical concept can be applied regardless of the number of panel pixels.

Also, in the above-described first embodiment, described was the case that an opportunity of light emission is given simultaneously to two rows of pixels in a single scanning unit, and one row of selected row interconnection is overlapped between this scanning unit and a next scanning unit, but this invention is not limited to this.

Also, according to this first embodiment, it is possible, for example, to have three rows of the pixels emitted light at the same time, and to timely change the number of row lines of a single scanning unit, every time two rows of the selected row interconnections are overlapped between this scanning unit and a next scanning unit. By this, it becomes possible to control panel emitted light luminance, adjustment of luminance lowering mitigation due to voltage drop which is generated on a row interconnection, and so on.

In addition, in case that the number of row lines are pluralized in a single scanning unit, and display row lines are partially overlapped between this scanning unit and a next scanning unit, if a normal method is used, there is a possibility of inviting lowering of vertical resolution in display image quality.

However, in case that display panel resolution is sufficiently high as compared with an input image signal, even if scanning of a plurality of row units is carried out, since resolution of the input image signal is low, it is possible to realize such a level that a user who uses an image display apparatus does not almost worry.

Also, according to the image display apparatus according to the above-described, this first embodiment, as compared with a structure for scanning by applying a scanning signal sequentially one scan interconnection by one scan interconnection, higher luminance display becomes possible. On that account, it becomes effective even in a case that a user desires high luminance rather than lowering of vertical resolution of display image quality.

Also, according to the first embodiment of this invention, as compared with a method for carrying out line sequential drive one row by one row, it is possible to suppress a response in a high area, and it becomes possible to hold a vertical resolution characteristic, and therefore, it becomes possible to reduce aliasing distortion in the high area. That is, it is possible to realize reduction of moire which is generated in a display image, and it becomes possible to realize high image quality of a display image apparatus.

Also, according to this first embodiment, since it is possible to reduce generation of unnecessary excess voltage, long life of a device can be realized. Also, it becomes possible to realize bright display or display with small irregularity of brightness while realizing precise gray scale display by use of pulse width modulation.

In the above-described first embodiment, described was the example of such scanning method that two rows of pixels are made to emit light simultaneously in a single scanning unit, and one row of a selected row interconnection is overlapped between this scanning unit and a next scanning unit, but this invention is not limited to this as a matter of course.

Second Embodiment

Next, an image display apparatus according to a second embodiment of this invention will be described. In addition, since the image display apparatus according to this second embodiment has the same structure as in the first embodiment, detailed explanation will be omitted.

For example, it becomes possible to select any one of such a scanning method that three rows of pixels are made to emit light at the same time and two rows of selected row interconnections are overlapped between a certain scanning unit and a next scanning unit, by adopting the scanning condition of the first invention which relates to this application, and such a method that four rows of pixels are made to emit light simultaneously and three rows of selected row interconnections are overlapped between a certain scanning unit and a next scanning unit, or it becomes also possible to make selection by use of a scanning condition which corresponds to the scanning condition of the first invention of this application as at least one option, and by use of a scanning condition which does not correspond to the scanning condition of the first invention of this application, and in which scanning signal is applied for example, with respect to each one line.

In this second embodiment, in order to determine a scanning condition, it was configured to detect information such as the number of pixels of the display panel 100, i.e., the number of scan lines, the number of effective display liens in one refresh period of an input image signal, and desired display luminance of a display apparatus, preference of a user of an image display apparatus and so on.

In this second embodiment, it was configured to carry out determination of the scanning condition and scan line number conversion processing by use of a judgment flow, and to generate a drive luminance signal from an input image signal which is inputted to the drive luminance signal generation unit 102. One example of this judgment flow is shown in FIG. 5.

Figure 5:
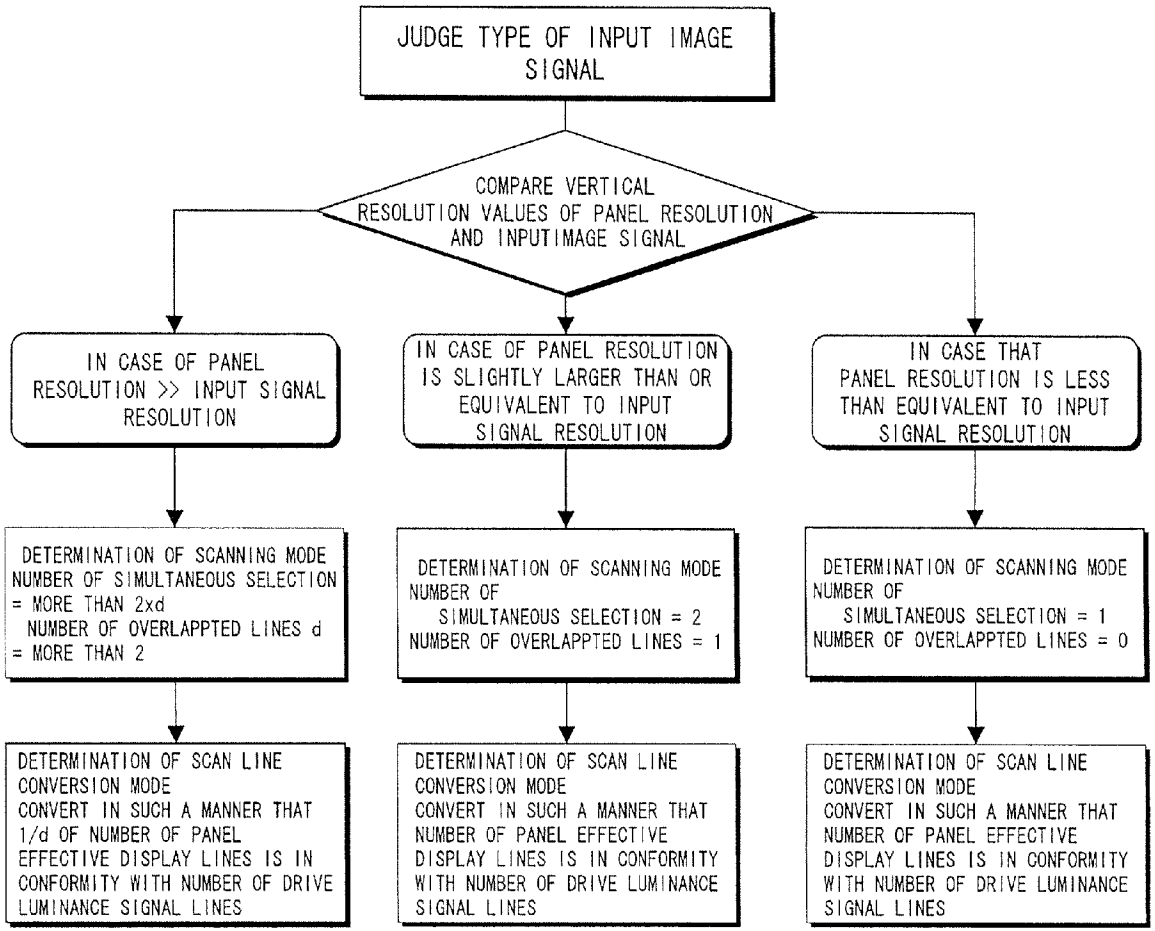
FIG. 5 is a judgment flow chart in carrying out scan line conversion processing for generating a driving luminance signal, from an input image signal according to the first embodiment of this invention.

As shown in FIG. 5, firstly, when an image signal is supplied from the input terminal 101 to the scanning condition determining unit 107, a type of an image signal inputted is detected by a detection unit which detects frequency of horizontal and vertical synchronous signals which are included in the input image signal.

In addition, the scanning condition determining unit 107 which is the control circuit has a non-volatile memory, a memory in which stored is a program for executing judgment and control on the basis of the flow shown in FIG. 5, and a central processing unit (CPU) which operates on the basis of a program.

Also, in the non-volatile memory, with respect to each type of an input image signal which is assumed in advance, saved are evaluation data in which vertical resolution characteristics, which are assumed for respective image signals to have, are digitalized, and evaluation data which shows the number of pixels of a display panel which is used in this image display apparatus.

And, by the vertical resolution characteristic of an image signal and a comparison result of the number of pixels of a display panel, image display is carried out by any one method of the following three methods.

Firstly, in a first method, like a case of displaying NTSC television signals on the display panel 100 which can display, for example, HDTV, in case that the number of scan interconnections of a display panel is judged to be dramatically many to the vertical resolution characteristic of the input image signal, four rows of pixels are made to emit light at the same time in a single scanning unit.

And, the scanning condition determining unit 107 outputs an instruction signal so as to carry out the scanning method in which two rows of selected row interconnections are overlapped between a certain scanning unit and a next scanning unit, and controls the timing generation unit 105, and thereby, the display panel 100 is scanned by the scan interconnection drive unit 104.

Also, at the same time, in case that carried out was such a scanning method that the scanning condition determining unit 107 has four rows of pixels emitted light simultaneously in a signal scanning unit, and two rows of selected row interconnections are overlapped between this scanning unit and a next scanning unit, in one refresh period, a vertical expansion rate which is in conformity with the number of effective times for the scan interconnection drive unit 104 to select scan interconnections of the display panel 100 is supplied to the drive luminance signal generation unit 102, and carried out is scan line number conversion processing by expansion using scan line interpolation.

Secondly, in case that the number of scan interconnections of the display panel 100 is almost equivalent to the vertical resolution characteristic of the input image signal, or like a case of displaying HDTV signals on an display device with the number of lines corresponding to XGA which is one type of computer signals, in case that resolution of the display panel 100 is slightly high, it is determined by the scanning condition determining unit 107 so as to carry out scanning which corresponds to the characteristic scanning condition of the invention which relates to this application in which two rows of pixels are made to emit light simultaneously in a single scanning unit, and one row of selected row interconnections is overlapped between this scanning unit and a next scanning unit. And, the timing generation unit 105 is controlled and the display panel 100 is scanned by the scan interconnection drive unit 104.

Also, at the same time, in case that carried out was such a scanning method that the scanning condition determining unit 107 has two rows of pixels emitted light simultaneously in a single scanning unit, and between this scanning unit and a next scanning unit, one row of selected row interconnections is overlapped, in one refresh period, a vertical expansion rate which is in conformity with the number of effective times for the scan interconnection drive unit 104 to select scan interconnections of the display panel 100 is supplied to the drive luminance signal generation unit 102, and carried out is scan line number conversion processing by expansion using scan line interpolation. Needless to say, there is a case that scan line number conversion by expansion processing is not required, such as a case in which the number of scan interconnections of a display panel is almost equivalent to the vertical resolution characteristic of the input image signal, and so on.

Thirdly, in case that the number of scan interconnections of an display device is low to the vertical resolution characteristic of the input image signal, it is determined by the scanning condition determining unit 107 so as to carry out such a scanning method that one row of pixels is made to emit light in a single scanning unit, and selected row interconnections are not overlapped between this scanning unit and a next scanning unit. And, the timing generation unit 105 is controlled and the display panel 100 is scanned by the scan interconnection drive unit 104.

Also, at the same time, the scanning condition determining unit 107 supplies a vertical expansion rate which is in conformity with the number of effective times for the scan interconnection drive unit 104 to select scan interconnections of the display panel 100 to the drive luminance signal generation unit 102, and carries out scan line number conversion processing by scan line interpolation and reduction which used skipping.

The above-described first through third methods are carried out on the basis of judgment of a controller which was disposed in the scanning condition determining unit 107.

However, in case that a scanning condition, which is desired by a user, was supplied from the user interface unit 112 to the scanning condition determining unit 107, it is operated so as to take precedence of this scanning condition.

In the judgment flow shown in FIG. 5, the scanning condition determining unit 107 operates so as to carry out display with high luminance preferably, in such a situation that comparison of an input image and resolution of a display device is carried out, and an admissible display resolution performance is maintained.

As another way of thinking, it is possible to adopt such a judgment flow that display luminance prevails rather than the display resolution performance. According to this technical concept, in the judgment flow shown in FIG. 5, even in "CASE THAT PANEL RESOLUTION IS SLIGHTLY UPPER THAN OR EQUIVALENT TO INPUT SIGNAL RESOLUTION", "CASE THAT PANEL RESOLUTION IS LESS THAN EQUIVALENT TO INPUT SIGNAL RESOLUTION" and so on, high luminance display becomes possible. As above, by adopting such a form that a display resolution characteristic is allocated to display luminance, higher luminance display becomes possible.

As above, image display with scanning condition change was described, but furthermore, in this embodiment, in response to the scanning condition change, change of linearity correction of an electron beam irradiation time—emitted light luminance characteristic, and inverse gamma correction condition for various picture making effects is carried out.

Also, in this embodiment, in order to mitigate uncomfortable feeling when the scanning condition is switched, switching of the scanning condition is carried out in a vertical blanking period. Also, during a period after image display was finished under a predetermined scanning condition until scanning condition change control is completed, a display operation is made to be stopped, and after change control of the scanning condition is finished and when such time that scanning can be initiated by a new scanning condition comes, a new display operation may be initiated.

Also, when the scanning condition is switched, black display may be carried out so as to hide turbulence of the scanning condition. Also, it is not necessarily limited to the black display, but it may be configured that an input image signal output is stopped, and an image like a test pattern with desaturated color such as gray display, blue display and so on is made to be displayed, and thereby, display disturbance is made to be blinded by the scanning condition change.

Furthermore, it may be configured that an input image signal output, which is inputted from outside, is stopped, and on the basis of a signal from a storage device such as a ROM etc. which was built in an image display apparatus which is known as an on-screen display, display is carried out so as to know that it is in a switching operation. In this regard, however, it is desired that, in the on-screen display, information is made to be displayed only on a part of a screen, and other portions are displayed with desaturated color, i.e., such a display that display disturbance due to the scanning condition change is blinded is carried out.

Third Embodiment

Next, an image display apparatus according to a third embodiment of this invention will be described. In addition, since a structure of the image display apparatus according to this third embodiment is the same as the structure of the image display apparatus according to the first embodiment, explanation will be omitted.

In this third embodiment, an image display apparatus shown in FIG. 1 varies the Vm power supply unit 108 and the Vss power supply unit 109 for determining level of drive signals which are applied to modulation and scan interconnections of the display panel 100, by the emitted light luminance control unit 106, and thereby, display luminance adjustment is carried out. Here, by use of luminance control means, display luminance of the image display apparatus is controlled.

In this third embodiment, it is configured that detected is information such as a type of an input image signal, desired display luminance of an image display apparatus, preference of a user who uses the image display apparatus and so on, and on the basis of them, luminance control is carried out, and luminance setting of a display apparatus is carried out as follows.

That is, firstly when an image signal is supplied from the input terminal 101 to the scanning condition determining unit 107, a type of an image signal to be inputted is judged.

In case that an inputted image signal is of a type which does not require high luminance, such as an output image from a computer, and so on, by the scanning condition determining unit 107, resolution prevails, and on the basis of this, determined is the number of scan interconnections which are selected at the same time.

On the other hand, in case that the inputted image signal is of a type which expects high luminance like NTSC signals, luminance prevails, and on the basis of this, determined is the number of scan interconnections which are selected at the same time.

And, in case that there was a brightness adjustment request from a user, by the emitted light luminance control unit 106, the Vm power supply unit 108 and the Vss power supply unit 109, which determine level of drive signals which are applied to the modulation and scan interconnections of the display panel 100, are varied, or signal level of an output drive luminance signal, which is supplied from the drive luminance signal generation unit 102, is varied, or both of them are carried out together.

In addition, there is a method for determining by such a way of thinking that, not for the purpose of increasing emitted light luminance, without changing the emitted light luminance of the display panel 100, the electron emission amount of respective pixels is reduced with an elongated portion of respective pixels selection time in one frame period.

That is, more concretely speaking, in case that two row simultaneous selection is carried out and at the time of next scanning selection, a scanning condition was determined so as to overlap one row, on the basis of a characteristic shown in FIG. 4, drive voltage is set in such a manner that an electron emission amount becomes approximately ½, and image display is carried out in such a situation that emitted light luminance of the display panel 100 does not change.

Judging from the characteristic chart shown in FIG. 4, according to this determining method, by having the device drive voltage reduced, not only the electron emission amount but also device drive current are reduced. On that account, it becomes possible not only to reduce drive current flowing through a row interconnection without lowering the emitted light luminance, but also to mitigate luminance lowering due to voltage drop which occurs on the row interconnection.

Also, according to the above-described first through third embodiments, it is possible to obtain a structure which can have compatibility which is preferable even in case that a low resolution image signal is received. Concretely speaking, it becomes possible to a signal processing technology for lowering an emitted light luminance performance of an display device by lowering display device drive duty which generally occurs in case of realizing high definition of a display panel, and for converting a low resolution signal to a drive luminance signal which is in conformity with a high definition display device.

Fourth Embodiment

Figure 6:
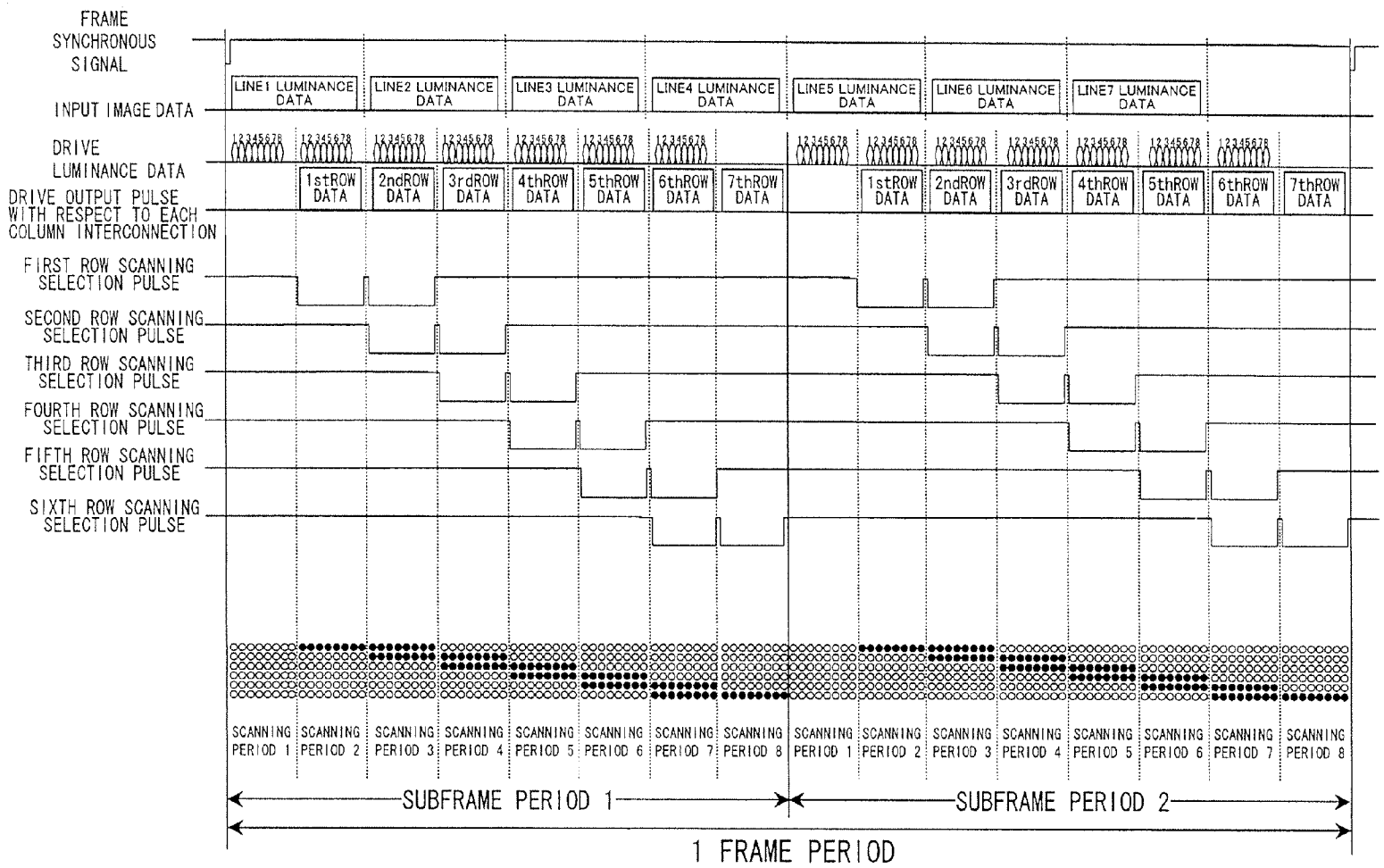
FIG. 6 is a timing chart showing timing of scanning of scan interconnections according to a fourth embodiment of this invention.

Next, an image display apparatus according to a fourth embodiment of this invention will be described. FIG. 6 shows one example of timing of scanning of scan interconnections according to this fourth embodiment. In addition, since the image display apparatus according to this fourth embodiment is the same as that in the first embodiment, explanation will be omitted. Also, in order to facilitate understanding, in the display panel according to this fourth embodiment, pixels thereof are assumed to be connected by matrix interconnections of 8 columns×6 rows.

As shown in FIG. 6, in scanning of the scan interconnections of the image display apparatus according to this fourth embodiment, one frame period is divided into two sub-frame periods, and respective sub-frame periods are configured by eight scanning periods, respectively. In respective sub-frame periods, display of one screen is carried out.

Also, a scan interconnection selection sequence with respect to each scanning period in these frame periods is defined as follows.

That is, firstly, a first scanning period is assigned to a non-display period. Next, in a second scanning period, by applying selection electric potential to a first row of scan interconnections, a first row of pixels is made to emit light. In addition, as to light emission, actually, it is not the case that pixels emit light only by application of selection electric potential to scan interconnections, but light is emitted by combined application of modulation signals to modulation interconnections, and application of selection electric potential corresponds to selecting pixels which can emit light, but in order to facilitate understanding of this invention, it is noted like this.

In a third scanning period, by applying selection electric potential to first and second rows of the scan interconnections, first and second rows of the pixels are made to emit light. In a fourth scanning period, by applying selection electric potential to second and third scan interconnections which were shifted with one scan interconnection portion from the first and second rows of the scan interconnections which are a group of the scan interconnections to which the scanning signal was applied in the third scanning period, second and third rows of the pixels are made to emit light.

Furthermore, in a fifth scanning period, by applying selection electric potential to third and fourth scan interconnections, third and fourth rows of the pixels are made to emit light. In a sixth scanning period, by applying selection electric potential to fourth and fifth scan interconnections, fourth and fifth rows of the pixels are made to emit light.

Also, in a seventh scanning period, by applying selection electric potential to fifth and six rows of the scan interconnections, fifth and sixth rows of the pixels are made to emit light. In an eighth scanning period, by applying selection electric potential to a sixth row of the scan interconnections, a six row of the pixels is made to emit light.

Also, one frame period is divided into two sub-frame periods, and, in respective sub-frame periods, in order to correspond to the above-described sequential selection scanning, drive luminance data is also divided into sub-frames on the basis of an input image signal.

And, in respective sub-frame periods, as a double speed line sequential signal having a scan line structure, generated is luminance data row which defined the amount of emitted light of respective pixels, and it is inputted to the modulation interconnection drive unit 103.

The modulation interconnection drive unit 103 holds this input luminance data during one scanning period. And, with respect to each scanning period and with respect to each modulation interconnection, for driving the modulation interconnections, outputted is a voltage pulse having effective electric potential which is in proportion to size of the luminance data.

Also, as shown in FIG. 6, in this fourth embodiment, it becomes possible to carry out surface display twice in one refresh period.

That is, according to the image display apparatus according to this fourth embodiment, concretely speaking, for example, in case that refresh frequency of an input image signal is 60 Hz, it correspond to such a situation that image display is carried out by such double refresh frequency that surface display frequency is 120 Hz, and it has such an advantage that it becomes possible to mitigate flicker interference of a display image due to the refresh frequency.

Fifth Embodiment

Figure 7:
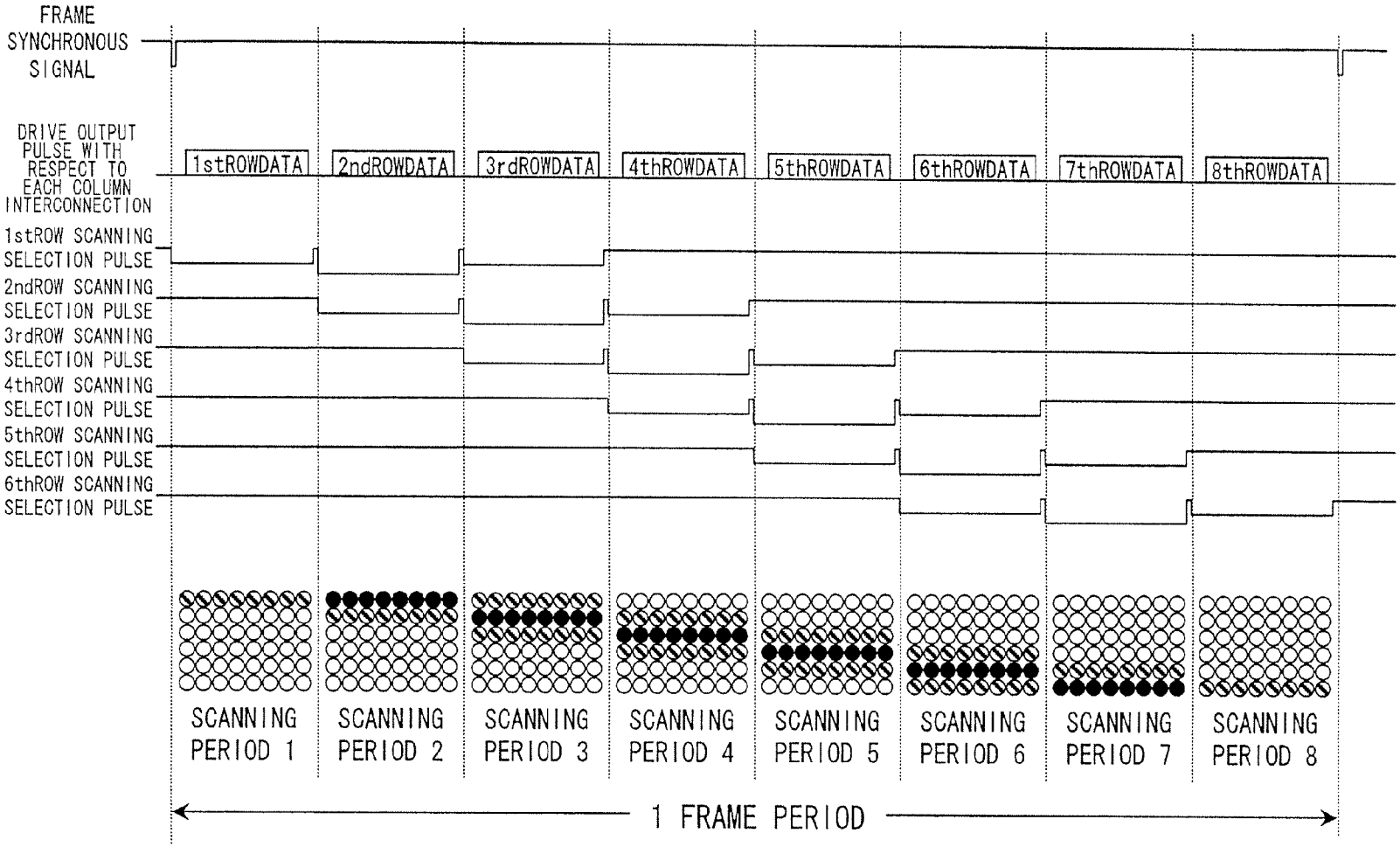
FIG. 7 is a timing chart showing timing of scanning of scan interconnections according to a fifth embodiment of this invention.

Next, an image display apparatus according to a fifth embodiment of this invention will be described. FIG. 7 shows one example of timing of scanning of scan interconnections according to this fifth embodiment. In addition, the image display apparatus according to this fifth embodiment is the same as that in the first embodiment, and as to the pixels of the display panel 100, they are assumed to be connected by matrix interconnections of 8 columns×6 rows.

In this fifth embodiment, one frame period is configured by eight scanning periods. And, luminance data in which the amount of light emission of respective pixels was defined is inputted to a column interconnection drive unit with respect to each one row in synchronous with this scanning period.

The modulation interconnection drive unit 103 holds this input luminance data during one scanning period. And, with respect to each scanning period and with respect to each column interconnection, for driving the column interconnections, as the modulation signal, outputted is a voltage pulse having pulse width which is in proportion to size of the luminance data.

Also, in the row scanning, maximum three rows of row interconnections are selected simultaneously by one scanning unit. To the three rows, i.e., upper, middle and lower rows of the interconnections which are selected at this time, electric potential, by which light can be emitted with maximum 100% luminance, is applied as selection electric potential to a center row interconnection.

On the other hand, in the upper, lower, two row interconnections, as a scanning signal having signal level which is different from signal level of a scanning signal which is applied to the center scan interconnection, applied is a selection electric potential by which light can be emitted with maximum 50% luminance. That is, amplitude of a voltage pulse which is applied as the scanning signal to the upper, lower, two scan interconnections is smaller than amplitude of pulse voltage which is applied to a center row interconnection.

Here, for example, when it is assumed that selection electric potential, which is applied to the center row interconnection and by which light can be emitted with 100% luminance, is VS1, and selection electric potential, which is applied to the upper, lower, two row interconnections and by which light can be emitted with 50% luminance, is VS2, a row interconnection scanning selection sequence with respect to each scanning period in one frame period is defined as follows.

Firstly, in a first scanning period, by applying the selection electric potential VS2 to a first row of the scan interconnections, a first row of the pixels is made to be able to emit light with 50% luminance.

Next, in a second scanning period, by applying the selection electric potential VS1 to the first row of the scan interconnections, and applying the selection electric potential VS2 to a second row of the scan interconnections, the first row of the pixels is made to emit light with 100% luminance, and a second row of the pixels is made to be able to emit light with 100% luminance.

In a third scanning period, by applying the selection electric potential VS2 to the first row of the scan interconnections, and applying the selection electric potential VS1 to the second row of the scan interconnections, and applying the selection electric potential VS2 to a third row of the scan interconnections, the second row of the pixels is made to be able to emit light with 100% luminance, and the first and a third rows of the pixels are made to be able to emit light with 50% luminance.

Also, in a fourth scanning period, by applying the selection electric potential VS2 to the second row of the scan interconnections, and applying the selection electric potential VS1 to the third row of the scan interconnections, and applying the selection electric potential VS2 to a fourth row of the scan interconnections, the third row of the pixels is made to be able to emit light with 100% luminance, and the second and a fourth row of the pixels is made to be able to emit light with 50% luminance.

Also, in a fifth scanning period, by applying the selection electric potential VS2 to the third row of the scan interconnections, and applying the selection electric potential VS1 to the fourth row of the scan interconnections, and applying the selection electric potential VS2 to a fifth row of the scan interconnections, the fourth row of the pixels is made to be able to emit light with 100% luminance, and the third and a fifth rows of the pixels are made to be able to emit light with 50% luminance.

Also, in a sixth scanning period, by applying the selection electric potential VS2 to the fourth row of the scan interconnections, and applying the selection electric potential VS1 to the fifth row of the scan interconnections, and applying the selection electric potential VS2 to a sixth row of the scan interconnections, the fifth row of the pixels is made to be able to emit light with 100% luminance, and the fourth and a sixth rows of the pixels are made to be able to emit light with 50% luminance.

Also, in a seventh scanning period, by applying the selection electric potential VS2 to the fifth row of the scan interconnections, and applying the selection electric potential VS1 to the sixth row of the scan interconnections, and applying the selection electric potential VS2 to a seventh row of the scan interconnections, the sixth row of the pixels is made to be able to emit light with 100% luminance, and the fifth row of the pixels is made to be able to emit light with 50% luminance.

Also, in an eighth scanning period, by applying the selection electric potential VS2 to the sixth row of the scan interconnections, the sixth row of the pixels is made to be able to emit light with 50% luminance.

As above, by adopting such a scanning method that, in a single scanning unit, relative density is divided in such a manner that, out of the upper, middle and lower, three rows, 10% is applied to the center row, and 50% is applied to the upper and lower rows, and three rows of the pixels are made to emit light simultaneously, as compared with a sequential scanning system of light emission lines one row by one row, it becomes possible to approximately double the emitted light luminance of the display panel 100.

Also, it is possible to realize, by the same structure, such an application that, not for the purpose of increasing emitted light luminance, without changing the emitted light luminance of the display panel 100, the electron emission amount of respective pixels is reduced.

Also, in a plurality of scan interconnections to which scanning signals are applied in one select period, by applying weighting to signal level of the scanning signals which are applied to them, respectively, it becomes possible to further control so as to have different vertical resolution response characteristics.

In addition, in this fifth embodiment, described was the example that luminance balance of a center line and upper and lower lines becomes 2:1, but needless to say, this invention is not limited to this ration, and it is possible to give various luminance ratios thereto.

And, by having this luminance ratio changed, it becomes possible to have a response characteristic changed. In this regard, however, it is preferable that a scan interconnection, to which a scanning signal with maximum weighting is applied, is changed sequentially with transition of the select period.

According to the above-described, the first through fifth embodiments of this invention, by carrying out the scanning control in the first invention of this application, while realizing high luminance, it has become possible to suppress shortening of life which becomes a problem on that occasion.

Also, as in the above-described second and third embodiments, it becomes possible to select the scanning condition, and it is possible to select preferred display, and it is possible to realize a structure which can change the scanning condition with suppressing turbulence of a display image.

Furthermore, it is possible to control display image quality and display luminance in an adaptive manner in response to input image signal type and user request, and it is possible to realize an image display apparatus by which user's usability was improved.

Sixth Embodiment

Next, a drive device of an image display apparatus according to a sixth embodiment of this invention will be described.

In this sixth embodiment, as a correction circuit which carries out edge emphasis, an edge emphasis circuit 206 is used, and other operations than an operation coming up with the edge emphasis are the same as in the above-described respective embodiments. In this regard, however, as the scanning circuit, used are a plurality of row drive circuits which correspond to a group of scan interconnections which are different from each other.

Figure 8:
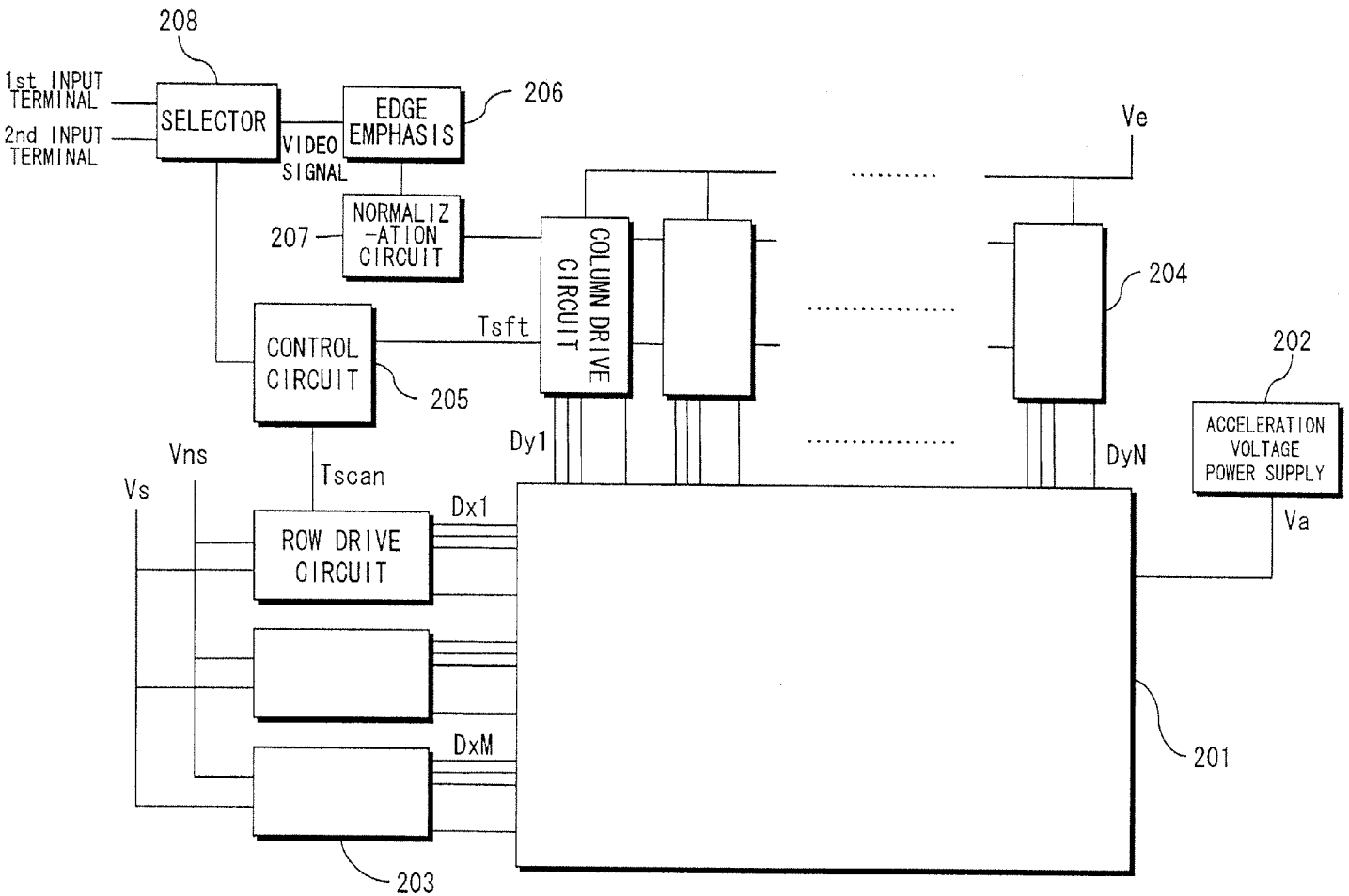
FIG. 8 is a block diagram showing a circuit structure of a self-luminous type display device according to a sixth embodiment of this invention.
Figure 9:
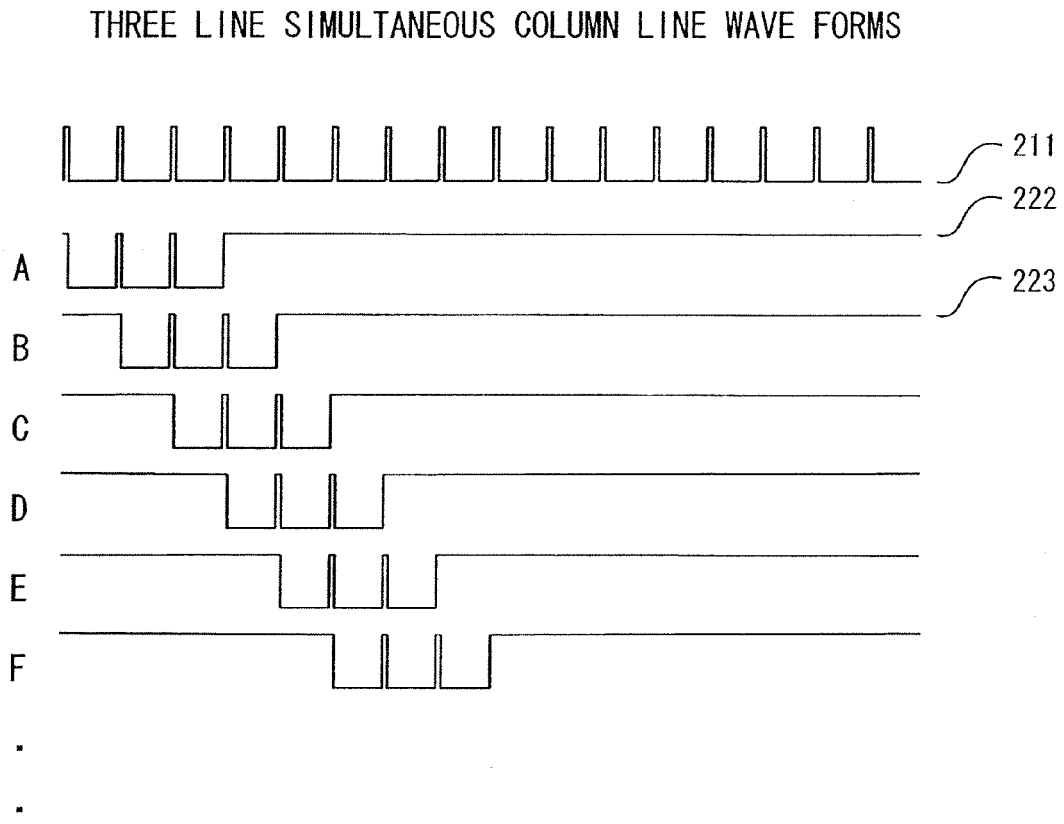
FIG. 9 is a wave form chart showing a scanning signal of a row driving circuit of the self-luminous display device according to the sixth embodiment of this invention.

Also, as the modulation circuit, used are a plurality of column drive circuits which correspond to a group of modulation interconnections which are different from each other. FIGS. 8, 9 and 10 show views for explanations regarding this sixth embodiment. FIG. 8 is a block diagram showing a circuit structure of the image display apparatus according to this sixth embodiment.

As shown in FIG. 8, in this sixth embodiment, further provided are the edge emphasis circuit 206 and a normalization circuit 207. A plurality of the row drive circuits 203 disposed are ones which are a plurality of row drive circuits and correspond to one scan interconnection drive circuit 104 in FIG. 1. Operations thereof are common.

In addition, as a video signal to be inputted, described is a digital video signal whose data processing is easier, but as an input signal, it is possible to adopt an analog video signal, but not limited to the digital video signal.

In this sixth embodiment, the control circuit 205 is a circuit which controls the row drive circuit 203 and the column drive circuit 204. Also, the edge emphasis circuit 206 which is a correction circuit is a circuit for edge-emphasizing a video signal in a row direction. Also, the normalization circuit 207 is a circuit which restricts an edge-emphasized signal to an operable range of the column drive circuit.

The control circuit 205 supplies, to the row drive circuit 203, as described later, an enable signal and a sink signal, so as to activate three rows at the same time, i.e., so as for the scanning signal to be added to three scan interconnections at the same time.

Also, the edge emphasis circuit 206, as described later, carries out the edge emphasis processing of the video signal in a row direction. And, a formula of the edge emphasis, for example, in order to obtain data of an edge-emphasized B line, is one for carrying out data processing such as new B=3B−A−C, new B=2B−A/2−C/2 and so on.

The normalization circuit 207 is one for carrying out restriction processing of the number of gray scales, to such a portion that data as a result of the edge emphasis exceeds a gray scale range of the drive circuit.

Also, as a restriction method of the number of gray scales, in case of respective color eight bit gray scale, since a range of data is 0 to 255, as a first method, there is such a method that a negative value is simply set to 0, and a value which exceeds 255 is set to 255.

Also, as a second method, there is such a method that one halves of the negative value are added to upper and lower pixels, and as to the value which exceeded 255, half of the excessive portion is added to the upper and lower pixels, respectively. After that, the corresponding pixel is set to 0 or 255.

Also, as a third method, there is such a method that one quarters of the negative value are added to upper and lower pixels, and as to the value which exceeded 255, one quarters of the excessive portion are added to the upper and lower pixels. After that, the corresponding pixel is set to 0 or 255.

Also, as a fourth method, there is such a method that one quarters of the negative value are added to left and right pixels, and as to the value which exceeded 255, one quarters of the excessive portion are added to upper and lower pixels. After that, the corresponding pixel is set to 0 or 255.

Also, as a fifth method, there is such a method that one quarters of the negative value are added to upper, lower and left, right pixels, and as to the value which exceeded 255, one quarters of the excessive portion are added to the upper and lower pixels. After that, the corresponding pixel is set to 0 or 255.

Other method for carrying out normalization than the above-described method is applicable. In addition, in the second method and the fifth method, a sum value of the pixels is held. Also, in the first method, the third method and the fourth method, the sum value changes.

In FIGS. 10C and 10D which will be described later, a case of normalization by the third method will be illustrated.

Here, the edge emphasis circuit 206 and the normalization circuit 207 can pass through data without carrying out respective processing. On that account, it is possible to output without carrying out processing, in case of data in which the resolution is important such as PC data in which there is no necessity to carry out the edge emphasis, and data which does not need the luminance.

Also, in the control circuit 205, in case of data in which the resolution is important such as PC data, and data which does not need the luminance, it controls in such a manner that applied is a scanning condition of applying scanning signals sequentially with respect to each one scan interconnection. In addition, in this embodiment, whether an input video is a TV signal or a PC signal is to be judged by an input path up to video data.

And, as shown in FIG. 8, by using such a structure that a plurality of video signal input terminals (a first input terminal and a second input terminal) are provided, and a video signal is inputted through a selector unit 208 to the edge emphasis circuit 206, and by applying information as to that a signal from which video signal input terminal is selected, to the control circuit 205, it is possible to judge.

FIG. 9 shows voltage wave forms of the scanning signals which are outputted to the row drive circuit which is the scanning circuit of the image display apparatus according to this sixth embodiment. In FIG. 9, 221 designates a Hsync signal wave form of Tscan which is inputted to the row drive circuit, and so-called sink signal 211.

Also, a reference numeral 222 designates a wave form of a scanning signal which is applied to a first row (scan interconnection) A, and a reference numeral 223 designate a wave form of a scanning signal which is applied to a second row B. And, in FIG. 9, after that, wave forms for driving rows C, D, E, F, respectively are shown.

And, these wave forms correspond like D×1=A, D×2=B . . . to D×1−D×M in FIG. 9, respectively. Also, electric potential Vns which is applied to a scan interconnection to which the scanning signal is not applied is for example, 5V, concretely speaking, and Vs which is electric potential level of the scanning signal is electric potential at a lower side of the wave forms 222, 223, concretely speaking, for example, −5V.

By this, in the three rows at the same time, the selection electric potential Vs is applied thereto as the scanning signal. And, as to an electron emitting device to which row drive electric potential Ve of e.g., 10V is applied, against the selection electric potential Vs in row driving, device voltage becomes, for example, 15V, and since it exceeds threshold voltage of e.g., approximately 8V, electrons are emitted.

On that account, with respect to each row to which Ve was applied consequently, electrons are to be emitted from three electron emitting devices. Also, this device voltage and threshold voltage are as shown in FIG. 4 which shows a relation of device current and emitting current.

FIG. 10 is a table which represented a correlation of data processing and output luminance according to this sixth embodiment. FIG. 10A shows an example of original video signal data, and FIG. 10B shows an example of data in which edge emphasis processing was applied to the original data (see, FIG. 10A), and FIG. 10C shows data in the course of normalization from FIG. 10B, and FIG. 10D shows data after normalization, and FIG. 10E shows values which simply trebled the original data (see, FIG. 10A), and FIG. 10F shows values which were obtained by adding the original data (see, FIG. 10A) after shifted with three lines, and FIG. 10G shows values which were obtained by adding the data after the edge emphasis processing (see, FIG. 10B) after shifted with three lines, and FIG. 10H shows values which were obtained by adding data after normalization (see, FIG. 10D) after shifted with three lines, by use of tables, respectively.

FIG. 10A corresponds to the video signal shown in FIG. 8, and shows a part of data of an area of gray scales 0 to 255 which correspond to one color out of respective colors of RGB. A video signal of RGB which was generated from this TV signal is of a wider portion than an actual display area.

Therefore, in this sixth embodiment, the area which is actually displayed is of after the third row from the top. IN addition, upper two rows are an area which is used for carrying out processing which will be described later without contradiction.

The original data (see, FIG. 10A) is inputted to the edge emphasis circuit 206. The edge emphasis processing which is carried out in the edge emphasis circuit 206 is emphasis processing toward a row direction. And, this edge emphasis processing, in the example shown in FIG. 10B, is set to new $B=2\times B-0.5\times A-0.5\times C$ as an edge emphasis formula to a B line. In addition, configured out are other several formulas whose emphasis levels are different from each other, than this example, such as new $B=2.5\times B-0.75\times A-0.75\times C$ and so on, but as the edge emphasis processing, judging from affinity of a video signal and a display device, and so on, it is possible to adopt an arbitrary method.

Also, a seventh embodiment, in case that it was configured so as not to carry out the edge emphasis processing, will be described later. In FIG. 10B, as a result of the edge emphasis, several coordinates protrude above and below the original gray scale range 0 to 255. That is, as data values, they are values of e.g., 290, −25 and so on.

In this connection, this protruded coordinate is restricted in the range in the normalization circuit 207. Hereinafter, in the seventh embodiment, the third method which was mentioned in FIG. 8 will be described.

That is, in the first half of the normalization processing, a result of having carried out "SUCH PROCESSING THAT ONE QUARTERS OF A NEGATIVE VALUE ARE ADDED TO UPPER AND LOWER PIXELS, AND AS TO THE VALUE WHICH EXCEEDED 255, ONE QUARTERS OF THE EXCESSIVE PORTION ARE ADDED TO THE UPPER AND LOWER PIXELS" is shown in FIG. 10C. On the other hand, in the last half, a result of having carried out "AFTER THAT, THE CORRESPONDING PIXEL IS SET TO 0 OR 255." is shown in FIG. 10D.

In FIGS. 10E through 10H, shown are gray scale range 0 to 767 which was obtained by expanding the original 8 bit gray scale range 0 to 255 three times in an upper direction, and values in the figure show gray scale strength values which represent relative gray scale strengths.

And, in almost proportion to this relative gray scale strength value, in detail, in accordance with a characteristic of fluorescent material of a display panel, luminance of respective colors of the display panel changes.

That is, FIG. 10F shows luminance output values which are obtained when three line simultaneous driving was carried out, by drive wave forms shown in FIG. 9, without carrying out data processing such as the edge emphasis processing and so on.

Also, FIG. 10G shows luminance output values which are obtained in case that simultaneous driving of the three lines was carried out, in the same manner, to data to which the edge emphasis processing was applied (see, FIG. 10B). This luminance output value is a value which is close to the value shown in FIG. 10E.

In the meantime, since the data to which the edge emphasis processing was applied (see, FIG. 10B) includes values outside the range, it can not be realized. In this connection, in this sixth embodiment, by use of data after normalization (see, FIG. 10D), a luminance output in case of three line simultaneous driving is obtained (see, FIG. 10H).

Since the luminance output shown in FIG. 10H is a value which is close to FIG. 10E, it is possible to obtain almost treble luminance to the original data (see, FIG. 10A).

Seventh Embodiment

Next, as a seventh embodiment, an example of a case of driving three lines simultaneously without carrying out the edge emphasis processing will be described. In this seventh embodiment, a desired luminance output, i.e., a gray scale strength value which corresponds to a desired luminance output is the value shown in FIG. 10E, which is treble value of the original data.

It is desired that the values shown in this FIG. 10E are luminance outputs which are close thereto as much as possible, but in case of a movie and so on, there is a case that soft display is preferred. Also, in case that there is grained feeling in an original video signal, and block noises are highly visible, there is such a case that no edge emphasis can assure a favorable display output.

In this connection, in this seventh embodiment, in the edge emphasis circuit 206 and the normalization circuit 207 shown in FIG. 8, respective predetermined processing is not carried out, and in the control circuit 205, timing is adjusted to the same timing as the case that processing was carried out to timing of data, and wave forms of FIG. 9 are obtained. By this, luminance to be outputted is luminance which corresponds to gray scale strength shown in FIG. 10F in case that only the three line simultaneous driving was carried out.

In the above-described sixth and seventh embodiments, described was the case that the number of lines which are driven at the same time is set to three lines, but this is absolutely one example, and it is not necessarily limited to the three lines.

Eighth Embodiment

Figure 11:
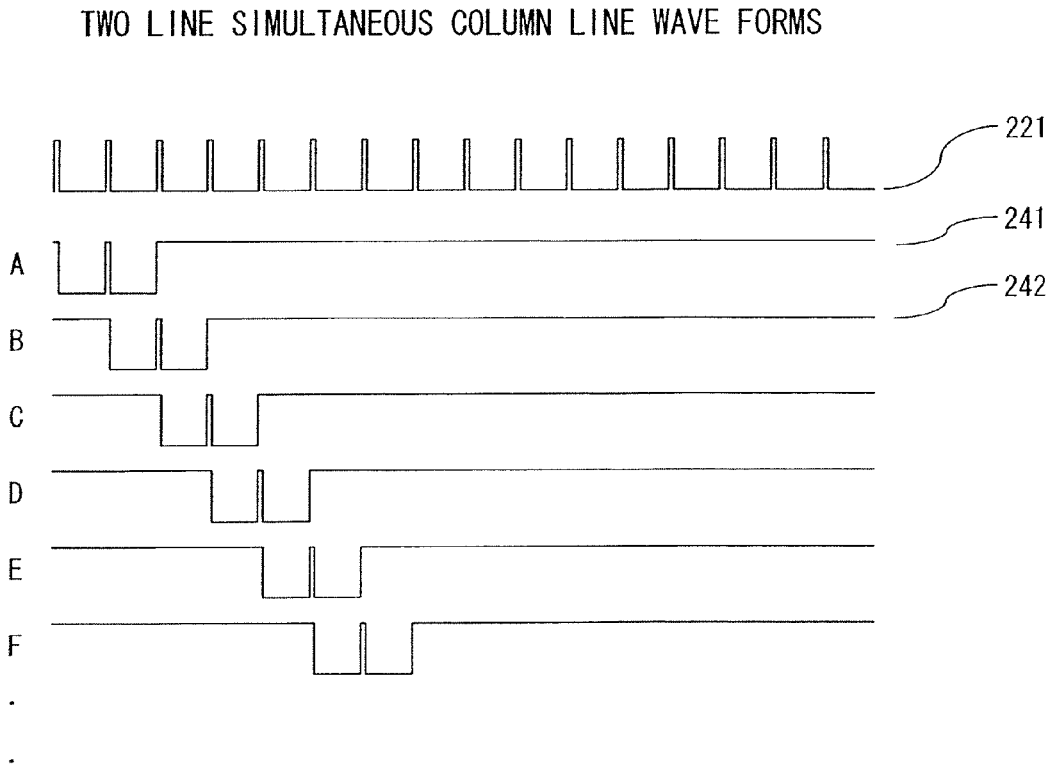
FIG. 11 is a wave form chart of a scanning signal which is outputted from a row driving circuit of a self-luminous type display device according to an eighth embodiment of this invention.

Next, an eighth embodiment of this invention will be described. That is, an example of driving two lines simultaneously will be hereinafter described by use of FIGS. 8, 11 and 12. FIG. 11 shows scanning signal wave forms which are outputted from row drive circuits of an image display apparatus of this eighth embodiment.

As shown in FIG. 11, the sink signal 211 is Ysync signal wave form of Tscan which is inputted to row drive circuits, and a reference numeral 241 designates a wave form for driving a first row A, and a reference numeral 242 designates a wave form for driving a second row B. and after that, wave forms for driving rows C, D, E, F, respectively are shown. In addition, the electric potentials Vns and Vs are the same as in the case shown in FIG. 9.

And, as to an electron emitting device to which column drive electric potential Ve of e.g., 10V is applied, against the selection electric potential Vs in row driving, if it exceeds threshold voltage of Vth e.g., approximately 8V, electrons are emitted, and therefore, consequently, with respect to each column to which Ve was applied, electrons are to be emitted from two electron emitting devices.

FIG. 12 is a table which represents a correlation of data processing and output luminance in the eighth embodiment of this invention. FIG. 12A shows an example of original video signal data, and FIG. 12B shows an example of data in which edge emphasis processing was applied to the original data (see, FIG. 12A), and FIG. 12C shows data in the course of normalization from FIG. 12B, and FIG. 12D shows data after normalization, and FIG. 12E shows values which simply doubled the original data (see, FIG. 12A), and FIG. 12F shows values which were obtained by adding the original data (see, FIG. 12A) after shifted with two lines, and FIG. 12G shows values which were obtained by adding the data after the edge emphasis processing (see, FIG. 12B)after shifted with two lines, and FIG. 12H shows values which were obtained by adding data after normalization (see, FIG. 12D) after shifted with two lines, respectively.

FIG. 12A corresponds to the video signal shown in FIG. 8, and shows a part of data of an area of gray scales 0 to 255 which correspond to one color out of respective colors of RGB. A video signal of RGB which was generated from this TV signal is of a wider portion than an actual display area.

Therefore, in this eighth embodiment, the area which is actually displayed is of after the third row from the top. In addition, upper two rows are an area which is used for carrying out processing which will be described later without contradiction.

The original data (see, FIG. 12A) is inputted to the edge emphasis circuit 206. The edge emphasis processing which is carried out in the edge emphasis circuit 206 is emphasis processing toward a row direction. And, this edge emphasis processing, in the example shown in FIG. 12B, is set to new $B=1.5\times B-0.5\times A$ as an edge emphasis formula to a B line.

In addition, configured out are other several formulas whose emphasis levels are different from each other, than this example, such as new $B=2.5\times B-A-0.5\times C$ and so on. And, as the edge emphasis processing, judging from affinity of a video signal and a display device, and so on, it is possible to adopt an arbitrary method. Also, such a case that the edge emphasis processing is not carried out will be described in a ninth embodiment which will be described later.

In FIG. 12B, as a result of the edge emphasis, several coordinates protrude the original gray scale range 0 to 255 mainly in a lower direction. For example, as data values, they are data values of −30 and so on.

In this connection, this protruded coordinate is restricted in the range in the normalization circuit 207. In this eighth embodiment, the above-described third method is adopted. That is, in the first half of the normalization processing, carried out is "SUCH PROCESSING THAT ONE QUARTERS OF A NEGATIVE VALUE ARE ADDED TO UPPER AND LOWER PIXELS, AND AS TO THE VALUE WHICH EXCEEDED 255, ONE QUARTERS OF THE EXCESSIVE PORTION ARE ADDED TO THE UPPER AND LOWER PIXELS", and its result is shown in FIG. 12C. On the other hand, in the last half, carried out is "AFTER THAT, THE CORRESPONDING PIXEL IS SET TO 0 OR 255.", and its result is shown in FIG. 12D.

In FIGS. 12E through 12H, shown are gray scale range 0 to 511 which was obtained by expanding the original 8bit gray scale range 0 to 255 in an upper direction, and values in the figure show gray scale strength values which represent relative gray scale strengths. And, in almost proportion to this relative gray scale strength value, in detail, in accordance with a characteristic of fluorescent material of a display panel, luminance of respective colors of the display panel changes.

FIG. 12F shows luminance output values which are obtained when two line simultaneous driving was carried out, by drive wave forms shown in FIG. 11, without carrying out data processing such as the edge emphasis processing and so on.

Also, FIG. 12G shows luminance output values which are obtained in case that simultaneous driving of the two lines was carried out, in the same manner, to data to which the edge emphasis processing was applied (see, FIG. 12B). This luminance output value is a value which is close to the value shown in FIG. 12E.

In the meantime, since the data to which the edge emphasis processing was applied (see, FIG. 12B) includes values outside the range, it can not be realized. In this connection, in this eighth embodiment, by use of data after normalization (see, FIG. 12E), a luminance output (see, FIG. 12H) in case of two line simultaneous driving is obtained. Since the luminance output shown in FIG. 12H is a value which is close to FIG. 12E, it is possible to obtain almost double luminance to the original data (see, FIG. 12A).

Ninth Embodiment

Next, a ninth embodiment of this invention will be described. In this ninth embodiment, an example of a case of two line simultaneous driving without carrying out the edge emphasis processing will be described. In addition, in this ninth embodiment, a desired luminance output, i.e., a gray scale strength value which corresponds to the desired luminance output is a value which is close to the double value shown in FIG. 12E of the original data.

In a normal video, it is desired to have a luminance output which is close to the value shown in FIG. 12E as much as possible, but in case of a movie and so on, there is a case that soft display is preferred. Also, in case that there is grained feeling in an original video signal, and block noises are highly visible, there is such a case that no edge emphasis can assure a favorable display output.

In this ninth embodiment, in the edge emphasis circuit 206 and the normalization circuit 207 shown in FIG. 8, respective predetermined processing is not carried out, and in the control circuit 205, timing is adjusted to the same timing as the case that processing was carried out to timing of data, and wave forms of FIG. 11 are obtained. In addition, luminance to be outputted is luminance which corresponds to gray scale strength shown in FIG. 12F.

Tenth Embodiment

Next, a tenth embodiment of this invention will be described. In this tenth embodiment, a case of driving row drive voltage by use of three kinds of voltages will be described by use of FIGS. 13 and 14.

Figure 13:
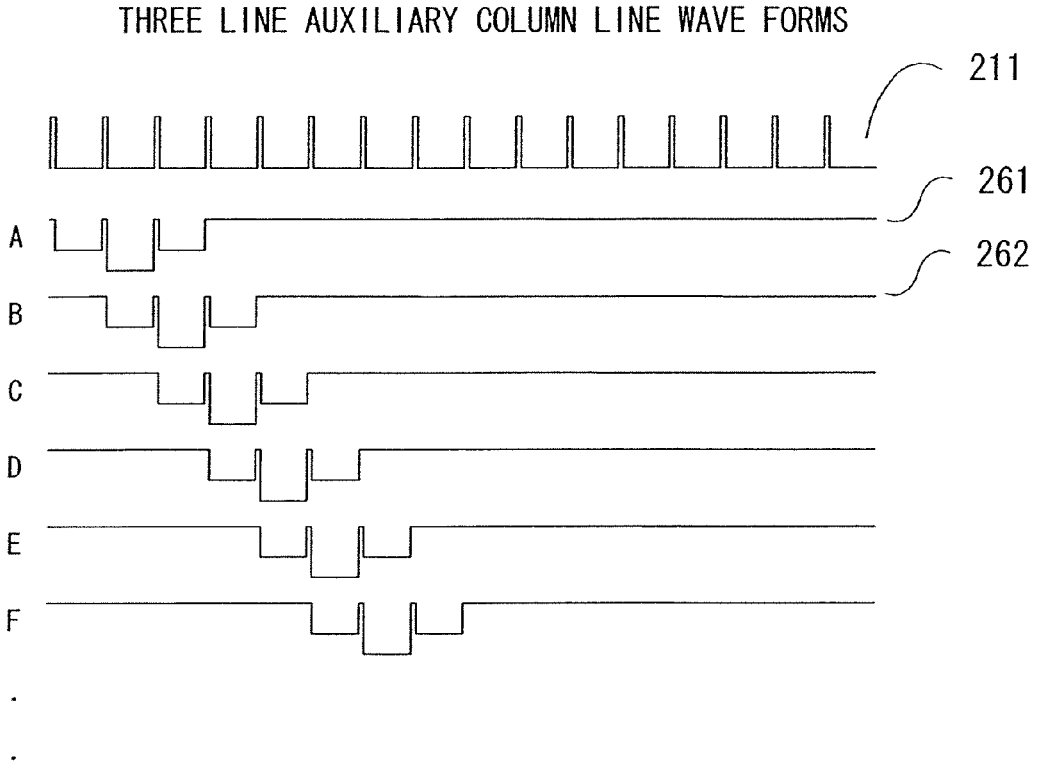
FIG. 13 is a wave form chart showing a scanning signal of a row driving circuit of the self-luminous display device according to a tenth embodiment of this invention.

FIG. 13 shows scanning signal wave forms which are outputted by row drive circuits of an image display apparatus according to the tenth embodiment of this invention. In FIG. 13, the sink signal 211 is the same as in the sixth through the ninth embodiments. Also a reference numeral 261 designates a wave form for driving a first row A, and a reference numeral 262 designate a wave form for driving a second row B, and after that, wave forms for driving rows C, D, E, F. respectively are shown.

In FIG. 13, the above-described Vns is a high side of the wave forms 261, 262, e.g., electric potential of approximately 5V, and Vs is a low side of the wave forms 261, 262, e.g., electric potential of approximately −5V. Furthermore, in this tenth embodiment, there exists drive electric potential Vhs. This drive electric potential Vhs is middle voltage between low side electric potential and high side electric potential of the wave forms 261, 262.

Drive electric potentials Vhs, Vs, and Vhs in these wave forms 261, 262 are driven sequentially in this order, every time that the row sink signal 211 rises. And, every time that the row sink signal 211 rises, adjacent rows are changed to Vhs, Vs, Vhs, pinching a portion which is controlled to low level between them.

By this, always, only one row becomes first selection electric potential Vs. At this time, previous and subsequent rows become second selection electric potential Vhs. In this regard, however, any one of Vs, Vhs corresponds to the scanning signal.

And, in an electron emitting device column to which column drive electric potential Ve of e.g., approximately 10V was applied, only an electron emitting device to which a first selection electric potential of e.g., approximately −5V becomes e.g., 15V, and voltage of e.g., approximately 12V is applied to two electron emitting devices to which a second selection electric potential of e.g., approximately −2V is applied. In this situation, if pulse width of the column drive electric potential is modulated, pulse width modulation can be realized.

These three electron emitting devices, since they exceed threshold voltage Vth of e.g., approximately 8V, emit electrons. Therefore, consequently, with respect to each column to which Ve was applied, electrons are to be emitted from three electron emitting devices.

At this time, in the graph shown in FIG. 4, it is assumed that emitting current Ie in case of device voltage is 12V is approximately a half of emitting current in case of device voltage 15V. In addition, in this embodiment, for ease of explanation, Vhs was defined in such a manner that Ie becomes just a haft, but in a practical sense, there is no necessity to define that Ie becomes a half, and it is possible to define it as one third, two third and so on. That is, it is possible to set Ie to an arbitrary value between 0 times and 1 times, by the value of Vhs.

FIGS. 14A through 14H show tables which represent correlation of data processing and output luminance in this tenth embodiment.

FIGS. 14A, 14B, 14C and 14D show similar tables as in FIG. 10. Also, FIG. 14E shows values which simply doubled the original data, and FIG. 14F shows values which were obtained by adding one halves of upper and lower lines to respective lines of the original data shown in FIG. 14A, and FIG. 14G shows values which were obtained by adding one halves of the upper and lower lines to respective lines, to data after the edge emphasis processing shown in FIG. 14B, and FIG. 14H shows values which were obtained by adding one halves of the upper and lower lines to the respective lines, to data after normalization shown in FIG. 14D.

In FIGS. 14E through 14H, shown is a gray scale range 0 to 511 which was obtained by extending the original 8bit gray scale range 0 to 255 in an upper direction, and values in the figures are gray scale strength values which represent relative gray scale strengths. Almost in proportion to this relative gray scale strength value, in detail, in accordance with a characteristic of fluorescent material of a display panel, luminance of respective colors of the display panel changes.

FIG. 14F shows luminance output values which are obtained when three line simultaneous driving was carried out, by drive wave forms shown in FIG. 13, without carrying out data processing such as the edge emphasis processing and so on. Here, a center is referred to Vs, and such a case that upper and lower rows thereof are driven by Vhs is referred to as three line auxiliary drive.

In this three lines auxiliary drive, obtained are additional values of one halves of luminance outputs of lines in upper and lower directions to luminance outputs of respective lines. In addition, a half of a luminance output is absolutely one example, and as described above, by electric potential of signal level Vhs of an auxiliary scanning signal, taken is a value between 0 and 1.

Also, FIG. 14G shows luminance output values which are obtained in case that simultaneous driving of the three lines was carried out, in the same manner, to data chart FIG. 14B to which the edge emphasis processing was applied. This luminance output value is a value which is close to the value shown in FIG. 14E. In the meantime, since the data to which the edge emphasis processing was applied (see, FIG. 14B) includes values outside the range, it can not be realized.

In this connection, in this tenth embodiment, by use of data after normalization (see, FIG. 14E), a luminance output (see, FIG. 14H) in case of three line simultaneous driving is obtained. Since the luminance output shown in FIG. 14H is a value which is close to FIG. 14E, it is possible to obtain almost double luminance to the original data (see, FIG. 14A)

Also, this invention is not limited to the above-described display apparatus which used FED, and the surface conduction type emitting device which is one development type thereof, and applicable to all self-light emission type displays.

Eleventh Embodiment

Next, an image display apparatus according to an eleventh embodiment of this invention will be described. In this eleventh embodiment, as an example of other matrix drive display apparatus, one which used an organic EL panel will be described.

Figure 15:
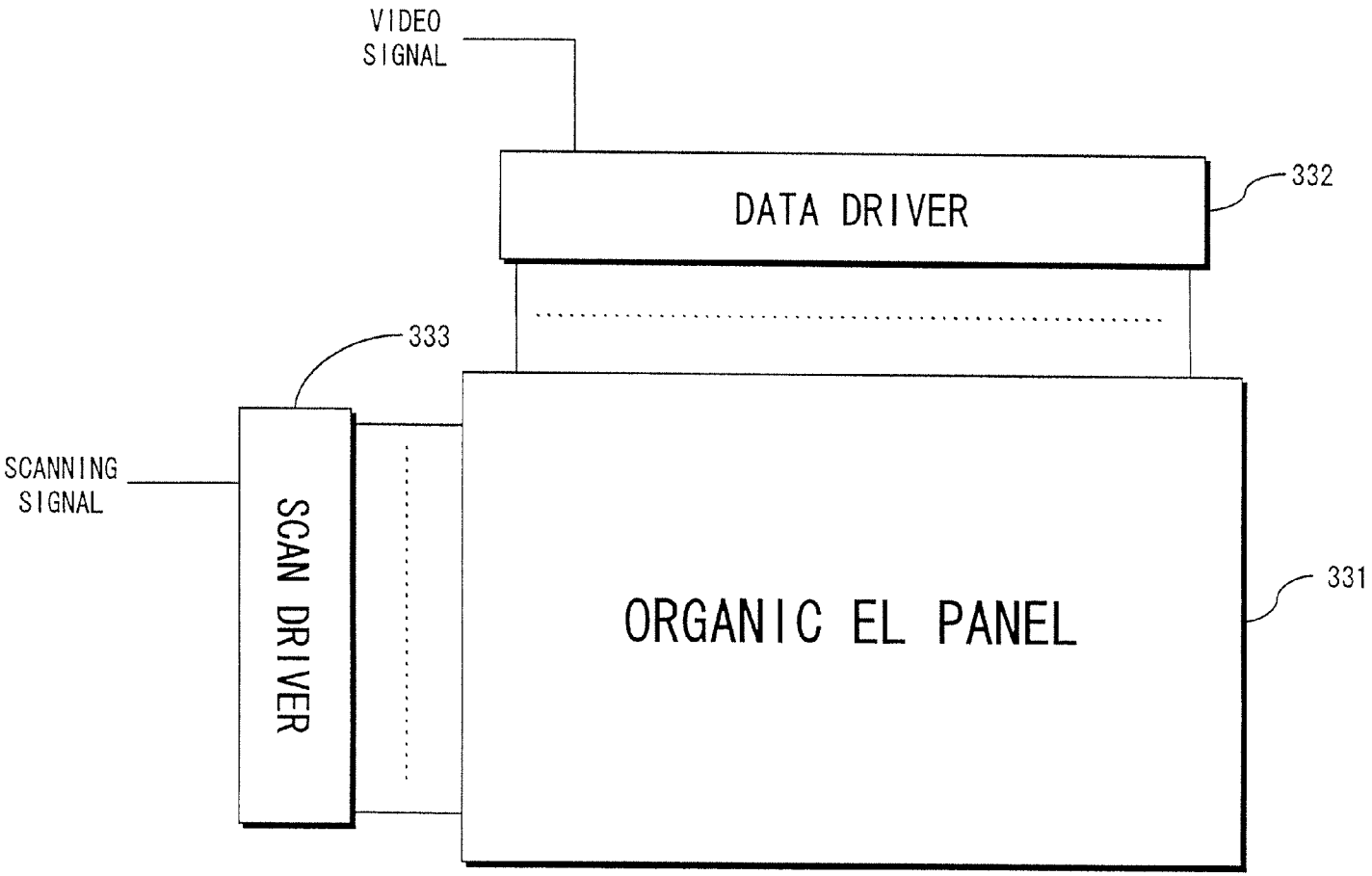
FIG. 15 is a block diagram showing a self-luminous type display with matrix drive by use of an organic EL panel.

FIG. 15 shows a structural example of a matrix drive display apparatus which used an organic EL panel according to this eleventh embodiment. As shown in FIG. 15, a self-light emission type display according to this embodiment is configured by having an organic EL panel 331, a data driver 332, and a scan driver 333.

With regard to drive wave forms of the scan driver 333 which is a scanning circuit, voltage values are different from those of FED and SED, but wave forms are the same. In addition, also with regard to video data which is supplied to the data driver 332 as a modulation circuit, it is the same as in FIGS. 10, 12 and 14.

Twelfth Embodiment

Next, a twelfth embodiment of this invention will be described. That is, as an example of another matrix drive image display apparatus, FIG. 16 shows a self-light emission type display which used an LED matrix.

Figure 16:
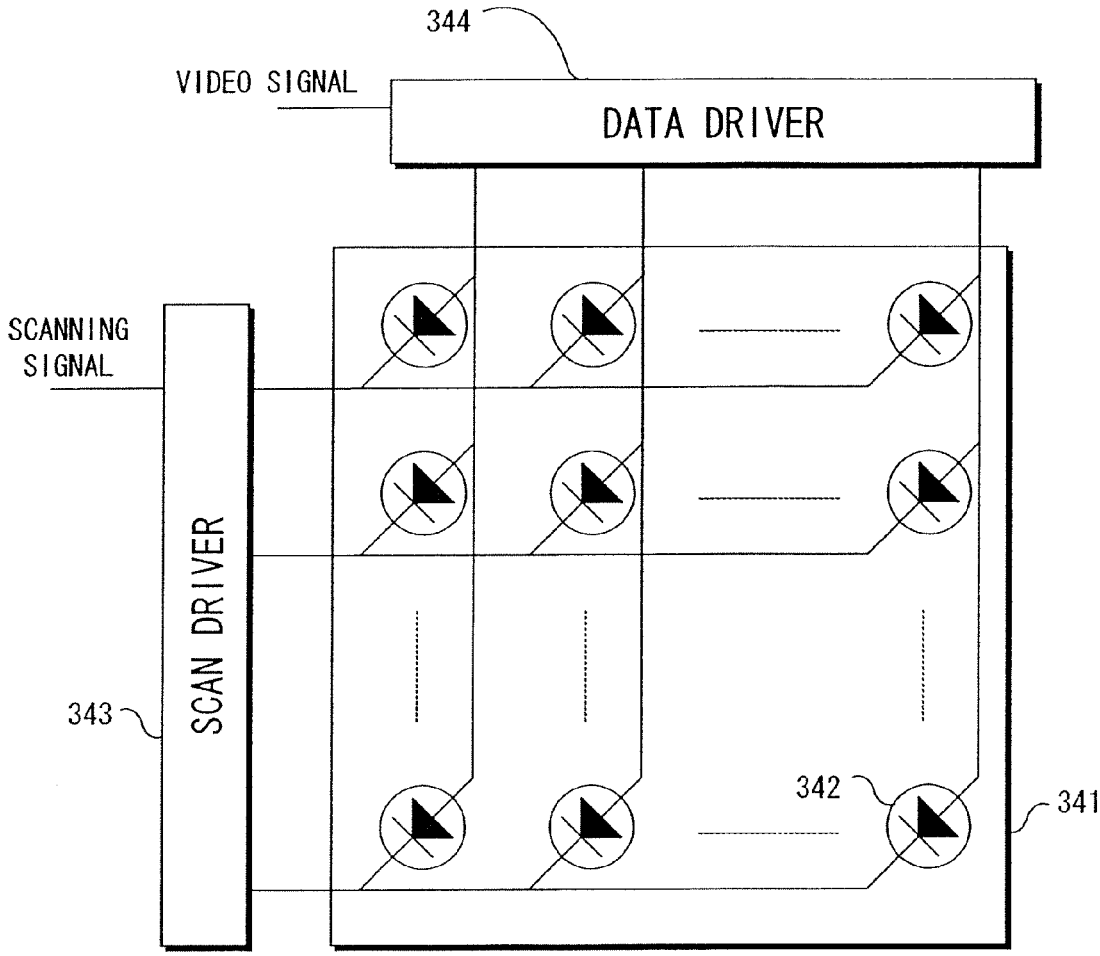
FIG. 16 is a block diagram showing a self-luminous type display by use of an LED matrix.

As shown in FIG. 16, this self-light emission type display which used the LED matrix is configured by having an LED matrix display 341, a plurality of LEDs 342, a scan driver 343 which is a scanning circuit, and a data driver which is a modulation circuit.

Also, with regard to drive wave forms of the scan driver 343 which is a scanning circuit, voltage values are different from those of FED and SED, but wave forms are the same. Also, with regard to video data which is supplied to the data side driver, it is the same as in FIGS. 10, 12 and 14.

As above, a plurality of embodiments of this invention were concretely described, but this invention is not limited to the above-described plurality of embodiments, and various types of modifications are possible on the basis of the technical concept of this invention.

For example, numerical values which were cited in the above-described embodiment are absolutely example, and other numerical values which are different from them may be used according to need.

As described above, according to this invention, it is possible to carry out preferred bright image display and image display with small irregularity of brightness, and to obtain a long life image display apparatus.

Also, according to this invention, it is possible to change a scanning condition on the occasion of image display, and to carry out the change of the scanning condition favorably. Furthermore, it is possible to realize display which is bright or has small irregularity of brightness, and has precise gray scale.

Also, according to this invention, it becomes possible to improve brightness of a display apparatus, and to select scanning conditions.

Also, according to this invention, in a display apparatus which carries out display by having electrons emitted and by having the emitted electrons accelerated, in case of obtaining the same luminance, acceleration voltage can be reduced, and therefore, there is such an advantage that it is possible to suppress occurrence of electric discharge from an anode.

What is claimed is:

1. An image display apparatus comprising a plurality of display devices;

a plurality of scan interconnections and a plurality of modulation interconnections, which configures a matrix interconnection for driving the plurality of display devices;

a scanning circuit for applying a scanning signal to the scan interconnections, wherein the scanning circuit is one which applies the scanning signals to a group of scan interconnections selected from the plurality of scan interconnections in one select period, and which applies the scanning signals, in a subsequent select period, to another group of scanning interconnections which were shifted with one scan interconnection portion from the group of scanning interconnections to which the scanning signals were applied in a previous select period, the output from the scanning circuit has a portion in which signal level is controlled to a non-selection electric potential level between said scanning signals which are applied repeatedly to said scanning interconnection, and a modulation circuit for applying a modulation signal to the modulation interconnections so that a pulse width of the modulation signal is accommodated in one selected period according to luminance data, and the initiation of the modulation signal is delayed from commencement of the selected period for the portion in which the scanning interconnection is on the non-selection electric potential level.

2. The image display apparatus according to claim 1, further comprising a control circuit for controlling in such a manner that the scanning circuit carries out scanning by any one scanning condition of such a first scanning condition that, in the successive select periods, the scanning signals are applied in a subsequent select period to a predetermined plural number of scan interconnections which were shifted with one scan interconnection portion from the plural number of scan interconnections to which the scanning signals were applied in a previous select period, and such a second scanning condition that the number of scan interconnections to which the scanning signals are applied repeatedly in successive two select periods, or the number of scan interconnections to which the scanning signals are applied simultaneously in one select period, or both of the number of scan interconnections to which the scanning signals are applied repeatedly in successive two select periods and the number of scan interconnections to which the scanning signals are applied simultaneously in one select period are different from that of the first condition.

3. The image display apparatus according to claim 2, wherein the control circuit carries out change from such a situation that the scanning circuit is scanning by the first scanning condition to such a situation that the scanning circuit is scanning by the second scanning condition, or change from such a situation that the scanning circuit is scanning by the second scanning condition to such a situation that the scanning circuit is scanning by the first scanning condition, during a period after one substantial screen was displayed until a next substantial screen is displayed.

4. The image display apparatus according to claim 2, further comprising a plurality of signal input terminals;

wherein the control circuit controls the scanning circuit by a scanning condition, which responded to the signal input terminal from which signals to be displayed are inputted, which was selected out of a plurality of scanning conditions containing at least the first scanning condition and the second scanning condition.

5. The image display apparatus according to claim 1, wherein the scanning circuit is configured to apply a scanning signal with different selection electric potential to a plurality of scan interconnections which are selected in one select period and the highest selection electric potential in each of successive select periods to a different scan interconnection in each select period.

6. The image display apparatus according to claim 1, further comprising a correction circuit which applies correction for emphasizing an edge of an image which is displayed, to a signal which is inputted.

7. The image display apparatus according to claim 6, wherein the correction circuit is configured to be able to carry out selection of application, non-application of the correction, and/or selection of level of correction in case of application.

8. The image display apparatus according to claim 1, wherein the display device comprises a device which is driven by an electric potential difference of electric potential of a scanning signal which is applied by the scan interconnection and electric potential of a modulation signal which is applied by the modulation interconnection.

* * * * *